US005873667A

United States Patent [19]

Inoue et al.

[11] Patent Number: 5,873,667

[45] Date of Patent: Feb. 23, 1999

[54] COSMETIC CONTAINER

[75] Inventors: Takashi Inoue, Fujisawa; Takeo Iwahori, Chigasaki; Kenichi Ito, Funabashi, all of Japan

[73] Assignee: Hidan Co., Chiba, Japan

[21] Appl. No.: 499,201

[22] Filed: Jul. 7, 1995

[30] Foreign Application Priority Data

| | | | |
|---|---|---|---|
| Jul. 8, 1994 | [JP] | Japan | 6-179658 |
| Mar. 31, 1995 | [JP] | Japan | 7-097515 |
| Mar. 31, 1995 | [JP] | Japan | 7-097516 |

[51] Int. Cl.[6] ..... A45D 40/06; A45D 40/12

[52] U.S. Cl. ..... 401/78; 401/80

[58] Field of Search ..... 401/78, 80

[56] References Cited

U.S. PATENT DOCUMENTS

| | | | |
|---|---|---|---|
| 3,515,493 | 6/1970 | Gruska | 401/78 X |
| 4,813,801 | 3/1989 | Cardia | 401/80 X |
| 5,096,318 | 3/1992 | Susini et al. | 401/80 |

FOREIGN PATENT DOCUMENTS

| | | | |
|---|---|---|---|
| 1016910 | 10/1957 | Germany | 401/78 |
| 6121709 | 5/1994 | Japan | 401/78 |
| 2244475 | 4/1991 | United Kingdom | 401/78 |

*Primary Examiner*—Steven A. Bratlie
*Attorney, Agent, or Firm*—Marshall & Melhorn

[57] ABSTRACT

In a cosmetic container an outer body portion surrounds a main body portion and is rotatable with respect thereto. Rotation of the main body moves a cosmetic holder up and down within the main body. An insert sleeve is fixedly secured to the outer body and surrounds the main body. The upper portion of the outer body is formed to provide an integral active portion positioned between the main body and the insert sleeve with gaps therebetween. The active portion of the outer body is provided with an inwardly projecting circular rib at an intermediate portion thereof which rotatably contacts the outer peripheral surface of the main body. The opposite end of the active portion of the main body elastically engages with the inner peripheral portion of the insert sleeve. Thus, the active portion of the outer body will act as a spring and can be deformed appropriately within the space between the main body and the insert sleeve.

24 Claims, 28 Drawing Sheets

FIG.18A
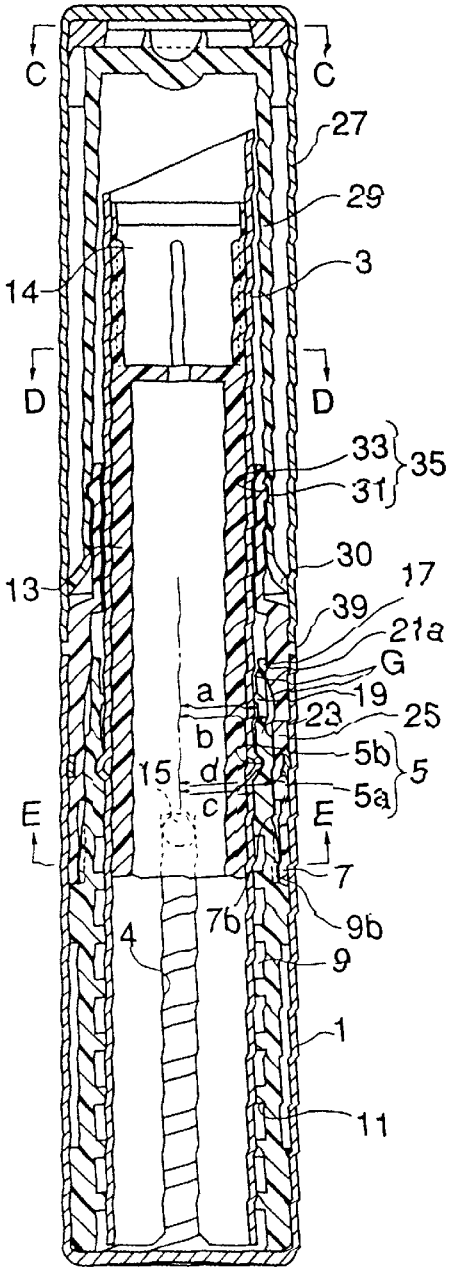
FIG. 18B
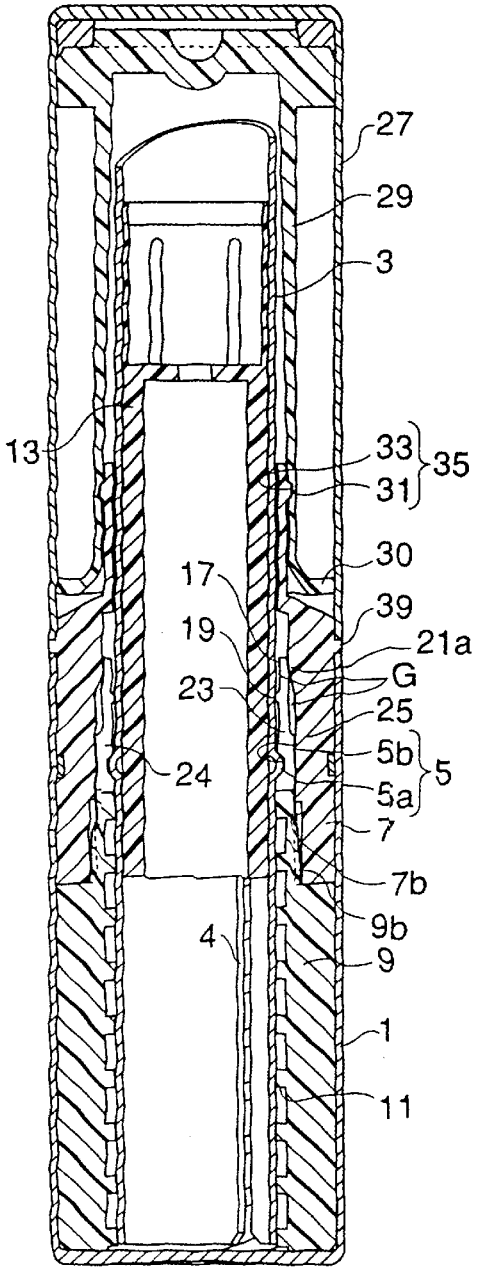
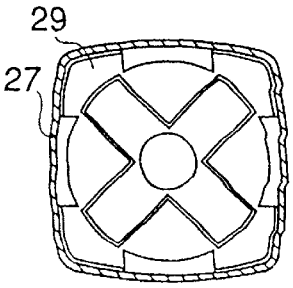
FIG.18 C
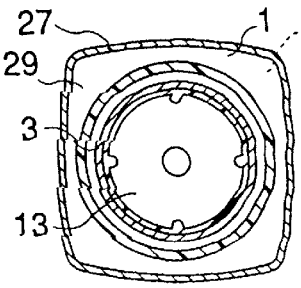
FIG.18 D
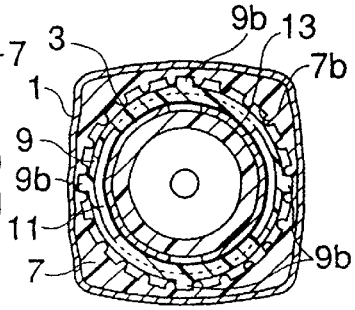
FIG.18 E

COSMETIC CONTAINER

BACKGROUND OF THE INVENTION

1. Field of the Invention

The present invention relates to a cosmetic container for receiving a stick-like cosmetic such as a lipstick, which can smoothly extract and retract a stick-like cosmetic such as a lipstick accommodated therein.

2. Description of the Prior Art

As a main body of a conventional cosmetic container, a cylindrical body formed by pressing a flat plate, namely a so-called pressing pipe, has been used. However, a great number of steps are required for manufacturing the pressing pipe, and it is difficult to make the cylindrical body to have a cross-section of a complete circle. Therefore, in order to reduce the number of the manufacturing steps, to improve dimensional precision of the main body, and to smoothen extraction and retraction of the cosmetic relative to the container, it has become the recent practice that a straight pipe formed by drawing is used as the main body.

FIG. 31 shows an example of a prior art cosmetic container using a straight pipe as a main body.

As shown in FIG. 31, within a decorative casing 200 having an upper open end, a main body 201 composed of a straight pipe formed by drawing is arranged co-axially and relatively rotatably therewith. There is a space between the casing 200 and the main body 201. A cylindrical outer body 205 provided with a continuous spiral groove 207 on an inner peripheral surface thereof is arranged between the casing 200 and the main body 201. The outer body 205 is integrally fitted to the bore of the casing 200. An insert sleeve 203 is permanently fitted to the upper end portion of the outer body 205 to rotatably surround the main body 201. Within the main body 201, a cosmetic holder 209 for receiving and holding a cosmetic is received. Diametrical projections 211, 211 opposed to each other are provided at the lower end portion of the holder 209. These projections 211, 211 pass through elongated slots 213, 213 provided in the lower portion of the main body 201 to engage with the spiral groove 207. On the outer periphery of the center portion of the main body 201 is formed a projecting bead 215 which is engaged with an internal recess 206 of the outer body 205 to prevent removal or separation of the main body 201. Reference numeral 216 indicates a cap for detachably closing the upper open end of the casing 200.

In use, by rotating an integral assembly comprising the casing 200, the outer body 205 and the insert sleeve 203, the projections 211, 211 in engagement with the spiral groove 207 are guided along the slots 213, 213 of the main body 201 to move up and down, to achieve extraction and retraction of the cosmetic holder 209.

In such a conventional cosmetic container, the outer body 205 is in contact with the main body 201, and the insert sleeve 203 is in contact with the outer body 205 and the main body 201, respectively.

However, a straight pipe manufactured by drawing will inevitably have a certain degree of diametrical dimensional error. The extraction and retraction property of the cosmetic container is greatly governed by frictional resistance between the main body 201 and the outer body 205, especially at the abutment portion at which the bead 215 is engaged within the recess 206. The frictional resistance would, in turn, vary depending upon dimensional relationship between the main 201, the outer body 205 and the insert sleeve 203.

For example, when the diameter of the insert sleeve 203 is relatively small, an excessive degree of frictional resistance may exist between the main body 201 and the outer body 205, and the cosmetic holder 209 can not be moved smoothly.

When a diameter of the insert sleeve 203 is relatively large, the frictional resistance between the main body 201 and the outer body 205 in the abutment portion is decreased. In this case, the cosmetic holder 209 can be moved too easily, and a user would have difficulty in using the cosmetic. Further, airtightness of the container is degraded, and there is a possibility of deteriorating the cosmetic by an invasion of the open air.

In another prior art, a lubricant such as silicon grease is applied to the contacts between the respective constituents of the container in order to smoothen extraction and retraction of the cosmetic. However, use of silicon grease is not desirable, because the cosmetic tends to deteriorate under the influence of components of the silicon grease during the long-term use.

It is lately in fashion to use a cosmetic hard to melt away, a moist cosmetic, etc. However, cosmetic of such a type has a relatively large content of a volatile substance. Therefore, unless the container provides a good airtightness, the cosmetic would be deteriorated. Further, when the airtightness of the container is not excellent, after the cosmetic is accommodated, so-called "slip-out" (a phenomenon that the cosmetic is contracted and consequently slipped out of the cosmetic holder); "desertion" (a phenomenon that the cosmetic cannot effectively cope with movement of the cosmetic holder); and "breakage" (a phenomenon that the cosmetic is contracted and consequently becomes easy to break). In order to prevent such phenomena, airtightness of the container becomes a critical requirement.

SUMMARY OF THE INVENTION

It is therefore an object of the present to provide a cosmetic container capable of smoothly moving a cosmetic without use of any lubricant.

Another object of the present invention is to improve airtightness in a cosmetic container especially using a straight pipe as a main body. With an improved airtightness of the cosmetic container, a volatile cosmetic can be used for a long time without generation of such phenomena as "slip-out", "desertion" and "breakage".

Still another object of the present invention is to provide a novel construction capable of preventing disadvantages which would otherwise be caused by inevitable dimensional errors in manufacturing cylindrical or tubular members constituting the cosmetic container.

In order to achieve these and other objects, according to an aspect of the present invention, there is provided a cosmetic container comprising: a main body provided at a lower portion thereof with slot means extending in a longitudinal direction; an outer body provided with a continuous spiral groove on an inner peripheral surface thereof, the outer body surrounding the main body substantially in close relation to each other but allowing relative rotation therebetween; a cosmetic holder accommodated within the main body substantially in close relation to each other but allowing relative longitudinal sliding movement therebetween, the cosmetic holder being provided with projection means projecting outwardly therefrom through the slot means to be in engagement with the continuous spiral groove so that the cosmetic holder moves longitudinally with respect to the main body in response to rotation of the outer body; an insert sleeve surrounding the main body and arranged fixedly with respect to the outer body; the upper portion of the outer body providing an active portion positioned between the main body and the insert sleeve with gaps therebetween; the active portion being provided at an intermediate portion thereof with circumferentially internal projecting means for relative rotatable contact with the outer peripheral surface of the main body; and opposite ends of the active portion being elastically engaged with the inner peripheral surface of the insert sleeve to thereby allow elastic deformation of the active portion.

The active portion preferably has an inner diameter larger than that of a lower main portion of the outer body and an outer diameter smaller than that of the lower main portion.

The inner peripheral surface of the insert sleeve may project inwardly at a position above the internal projecting means of the active portion for contacting with outer peripheral surface of the active portion.

The upper end portion of the active portion may be spread out towards the insert sleeve for contacting with the inner peripheral surface of the insert sleeve.

The internal projecting means of the active portion may be formed as a series of spaces, annularly arranged dot-like projections, or an endless continuous annular rib.

The outer peripheral surface of the upper end portion of the active portion may be provided with circumferentially external projecting means, which may be formed as a series of spaced, annually arranged dot-like projections, or an endless continuous annular rib.

The active portion may extend from the upper end of the outer body to above an abutment at which the main body is engaged with the outer body to be prevented from removal out of the outer body. In this case, a lower portion of the insert sleeve may be of uniform diameter or spread out toward the outer body.

Alternatively, the active portion may extend from the upper end of the outer body to below an abutment at which the main body is engaged with the outer body to be prevented from removal out of the outer body. Likewise, in this case, a lower portion of the insert sleeve may be of uniform diameter or spread out toward the outer body.

According to a preferred embodiment, the cosmetic container further comprises a casing surrounding the outer body, and a cap with an inner cap detachably engaged with the inset sleeve in an airtight condition. The casing, the insert sleeve and the cap are all made of metal to improve airtightness of the cosmetic container.

In the above-mentioned cosmetic container according to the present invention, when the active portion interposed between the insert sleeve and the main body can be elastically deformed in accordance with an inwardly directing force or stress through the casing and/or the outer sleeve, as well as in conformity to the interstice between the insert sleeve and the main body. More particularly, when the insert sleeve presses inwardly the active portion at the upper contact point therebetween, the internal projecting means of the active portion acts as a fulcrum, so that the other end of the active portion is urged to press outwardly on the insert sleeve.

In other words, the active portion moves like a seesaw or a spring and the opposite ends thereof tend to move in opposite directions. Accordingly, the excessive force applied to one end of the active portion may be effectively offset at the other end thereof because of the gap between the outer body and the insert sleeve. The frictional resistance at the abutment between the main body and the outer body remains substantially unchanged. The outer body, the main body and the insert sleeve can be assembled in favorable airtight condition. Moreover, possible disagreement in diameters of the constituents can be absorbed by the gaps surrounding the active portion, thereby maintaining airtightness and extraction/retraction properties of the cosmetic container.

Thus, the cosmetic container of the present invention satisfies smooth extraction/retraction property without use of any lubricant, while maintaining an improved airtightness, and is therefore particularly suitable for use as a volatile container.

According to another aspect of the present invention, there is provided a cosmetic container comprising: a main body provided at a lower portion thereof with slot means extending in a longitudinal direction; an outer body provided with a continuous spiral groove on an inner peripheral surface thereof, the outer body surrounding the main body substantially in close relation to each other but allowing relative rotation therebetween; a cosmetic holder accommodated within the main body substantially in close relation to each other but allowing relative longitudinal sliding movement therebetween, the cosmetic holder being provided with projection means projecting outwardly therefrom through the slot means to be in engagement with the continuous spiral groove so that the cosmetic holder moves longitudinally with respect to the main body in response to rotation of the outer body; an insert sleeve surrounding the main body and arranged fixedly with respect to the outer body; the upper portion of the outer body providing an active portion positioned between the main body and the insert sleeve with gaps therebetween; and the active portion being elastically engaged with the inner peripheral surface of the insert sleeve to allow elastic deformation of the active portion.

The active portion may be provided with circumferentially external projecting means for contacting with the inner peripheral surface of the insert sleeve. The external projecting means may be formed as a series of spaced, annularly arranged dot-like projections, or an endless continuous annular rib.

The upper end of the active portion may be spread out toward the insert sleeve for contacting the inner peripheral surface of the insert sleeve.

The inner peripheral surface of the insert sleeve may be provided with circumferentially internal projecting means for contacting with the outer peripheral surface of the active portion. The internal projecting means may be formed as a series of spaced, annularly arranged dot-like projections, or an endless continuous annular rib.

In accordance with the above-described cosmetic container of the present invention, disagreement of diameters among the main body, the outer body and the insert sleeve can be absorbed by spring effects of the active portion. More particularly, the active portion suitably changes its shape in a space encircling the abutment between the main body and the outer body.

Further, since the active portion is always in contact with the abutment between the main body and the outer body by an appropriate elastic force due to its spring effects, the outer body may be smoothly rotated relative to the main body.

BRIEF DESCRIPTION OF THE DRAWINGS

The above and further objects and advantages of the present invention will become apparent to those skilled in the art upon reading of the following description and by reference to the accompanying drawings in which:

FIGS. 18A to 18E are longitudinal and transverse cross-sectional view showing the cosmetic container according to still another embodiment of the present invention;

DETAILED DESCRIPTION OF THE PREFERRED EMBODIMENT

Figure 1A:
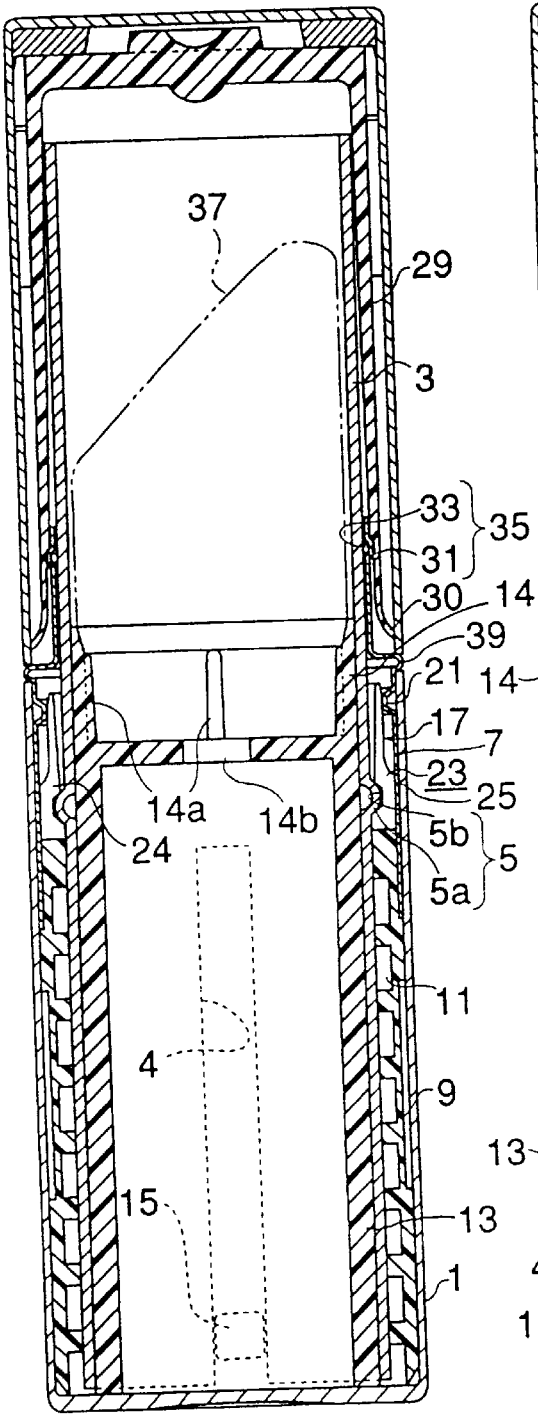
FIGS. 1A and 1B are longitudinal cross-sectional views showing an embodiment of a cosmetic container according to the present invention.
Figure 1B:
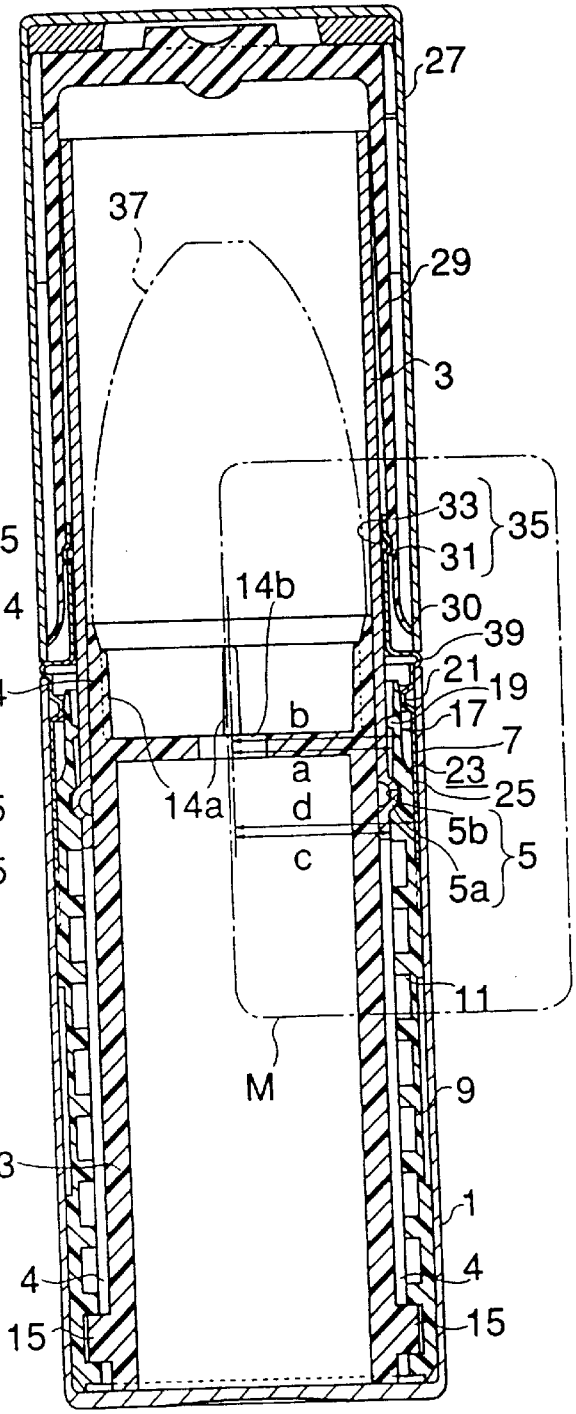

A preferred embodiment of the present invention will be hereinunder described with reference to FIGS. 1 and 2. FIGS. 1A and 1B are cross-sectional views taken along vertical planes perpendicular to each other.

A cosmetic container of the illustrated embodiment includes a cylindrical casing 1 having an upper open end, and a main body 3 coaxially arranged and received within casing 1 with some diametrical gap therebetween. Main body 3 having upper and lower open ends is made of a straight pipe formed by drawing etc. A pair of elongated slots 4 are provided in symmetrical location of a lower portion of main body 3.

Main body 3 has the same diameter over its entire length except circumferentially projecting external bead 5*a* located in a center position thereof. Bead 5*a* cooperates with an annular groove 5*b* formed at an upper portion of an outer body 9 to form an abutment 5 between main body 3 and outer body 9. Outer body 9 may be rotated with respect to main body 3, while preventing separation therebetween by means of abutment 5 acting as a stop. At least one slit 24 is formed in the upper portion of outer body 9 to aid in coupling outer body 9 to main body 3 by aiding in the temporary elastic deformation of the upper portion of the outer body 9.

An insert sleeve 7 is located between main body 3 and casing 1. More particularly, the upper portion of insert sleeve 7 airtightly encircles main body 3 and its lower portion is interposed between outer body 9 and casing 1. Outer body 9 is fitted within casing 1. Thus, casing 1, insert sleeve 7 and outer body 9 are assembled in one united body and in use moved in unison.

An elavatable cosmetic holder 13 is encapsulated by main body 3. Cosmetic holder 13 has a receptacle 14 for receiving a stick-like cosmetic 37. On the outer peripheral surface of cosmetic holder 13 at the lower end thereof, there is integrally formed a pair of opposed projections 15, 15 which project outwardly to pass through slots 4 and engage with a continuous spiral groove 11 formed on the inner peripheral surface of outer body 9. Spiral groove 11 is located beneath annular groove 5*b*. Reference numeral 14*a* indicates a vertically extending stripe projection on the inner peripheral surface of holder 13. Reference numeral 14*b* indicates an aperture on the bottom of holder 13.

Figure 2:
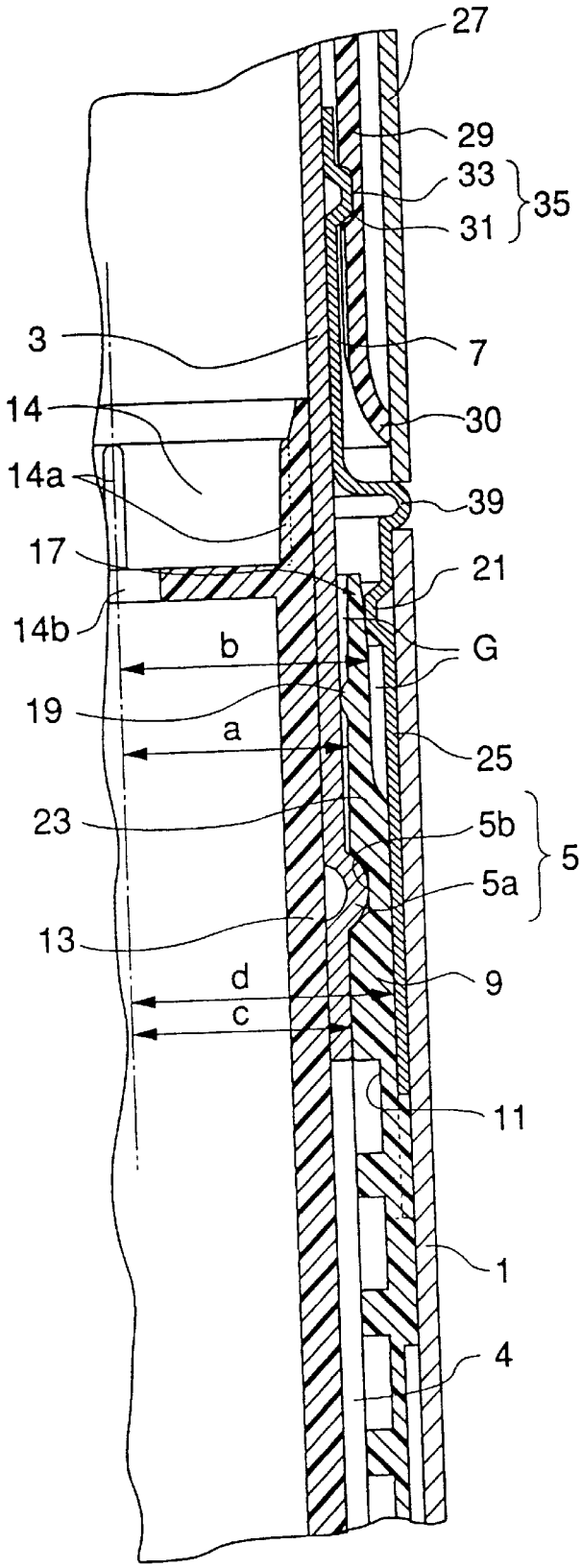
FIG. 2 is an enlarged view of an M portion in FIG. 1.

In further reference to FIG. 2, outer body 9 extends upwardly to form an integral active portion 17 which terminates at a location just above annular groove 5*b*. Active portion 17 has an inner diameter (a) larger than an inner diameter (c) of a lower main portion of outer body 9 and an outer diameter (b) smaller than an outer diameter (d) of the lower main portion. Accordingly, there are gaps G between main body 3 and active portion 17, and also between insert sleeve 7, and active portion 17. Active portion 17 is provided with a circumferentially inwardly projecting rib 19 where active portion 17 contacts the outer peripheral surface of main body 3. In the illustrated embodiment, rib 19 is formed as a series of spaced, annually arranged dot-like projections. At a location above rib 19, the outer peripheral surface of active portion 17 contacts with a projection or bead 21 formed integrally on the inner peripheral surface of insert sleeve 7. The outer peripheral surface of the lower end portion 23 of active portion 17 is in face-to-face contact with a straight-extending inner peripheral surface of the lower portion 25 of insert sleeve 7.

A cap 27 has an inner cap 35 fitted therein having an annular recess 33 which cooperates with circumferentially projecting external bead 31 on the top portion of insert sleeve 7 to form detachable coupling means 35 between inner cap 29 and insert sleeve 7. The lower end 30 of inner cap 29 may be spread outwardly, which makes it easier to attach and detach a cap assembly with respect to insert sleeve 7 (or cosmetic container itself). Insert sleeve 7 has the largest diameter at an intermediate bead portion 39, which is located on the upper end rim of casing 1 for mounting cap 27 thereon.

In the above-described embodiment, the cosmetic 37 is received by receptacle 14 by inserting a solidified stick-like cosmetic through the open upper end thereof.

In this embodiment, casing 1, main body 3 and cap 27 are made of metal such as aluminum and insert sleeve 7 is made of metal such as brass. For example, outer body 9, cosmetic holder 13 and inner cap 29 are made of polyacetal (POM), polypropylene (PP) and linear low-density polyethylene (L-LDPE), respectively.

Figure 7A:
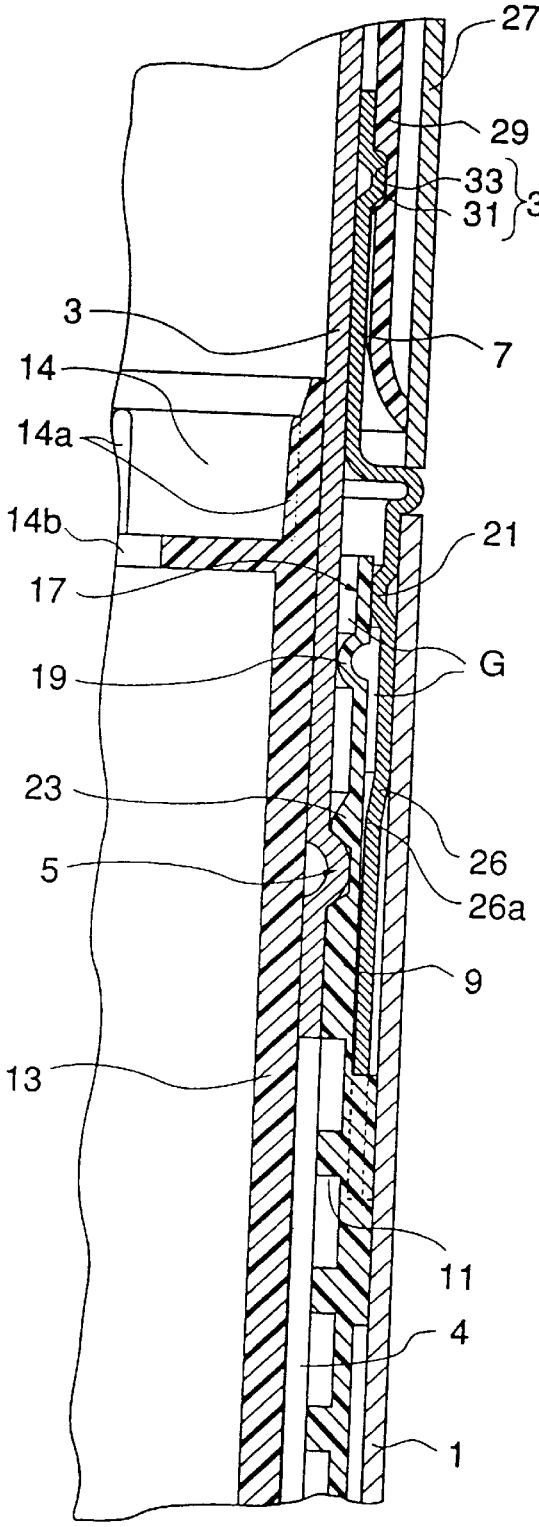
FIG. 7 is an enlarged view showing M portion of still another embodiment.
Figure 7B:
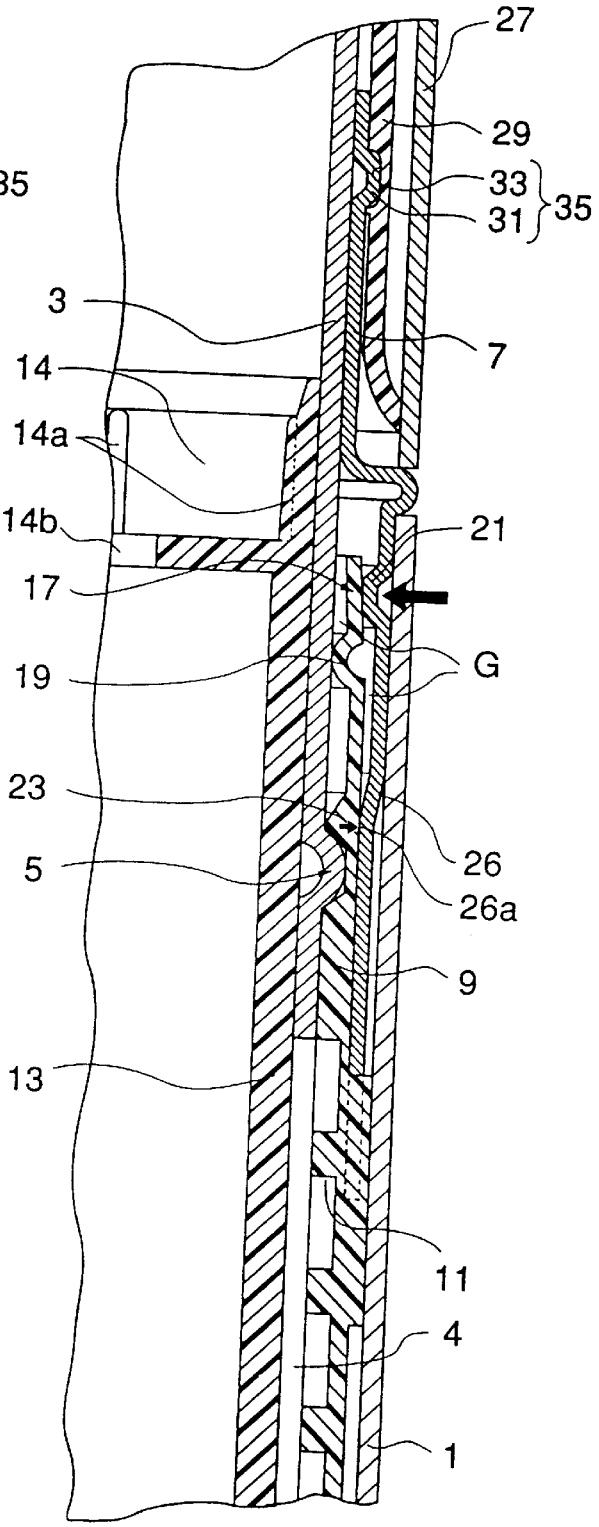

With the above-described cosmetic container, when insert sleeve 7 is tightly encapsulated by casing 1 so that some external force is applied to insert sleeve 7, as shown in FIG. 7B, projection 21 of insert sleeve 7 acts as a point of force and urges the upper end portion of active portion 17 of outer body 9 to be elastically deformed inwardly. Meanwhile, the lower end portion 23 of active portion 17 acts as a point of action and urges a contact point 26*a* of the lower portion 26 of insert sleeve 7 to move outwardly, that is, in a direction opposite to that of movement of outer body 9. In other words, active portion 17 of outer body 9 acts like a spring, thereby improving airtightness between main body 3 and insert sleeve 7.

In such spring-like function of active portion 17, rib 19 acts as a fulcrum. Even if an excessive external force is applied to the upper end of active portion 17 through projection 21, such an excessive force would be prevented from being transmitted to main body 3 by offset movement of the lower portion at the contact point 26*a*. Accordingly, a frictional resistance between main body 3 and outer body 9 at the abutment portion 5 can substantially remain unchanged to maintain smooth extraction/retraction characteristics of the cosmetic container.

There is also an improved airtightness at the coupling portion 35 between insert sleeve 7 and inner cap 29, more particularly between bead 31 and recess 33.

In the above-mentioned embodiment, various modifications can be made. For example, rib 19 may be formed as a continuous, endless annular projection.

Figure 3:
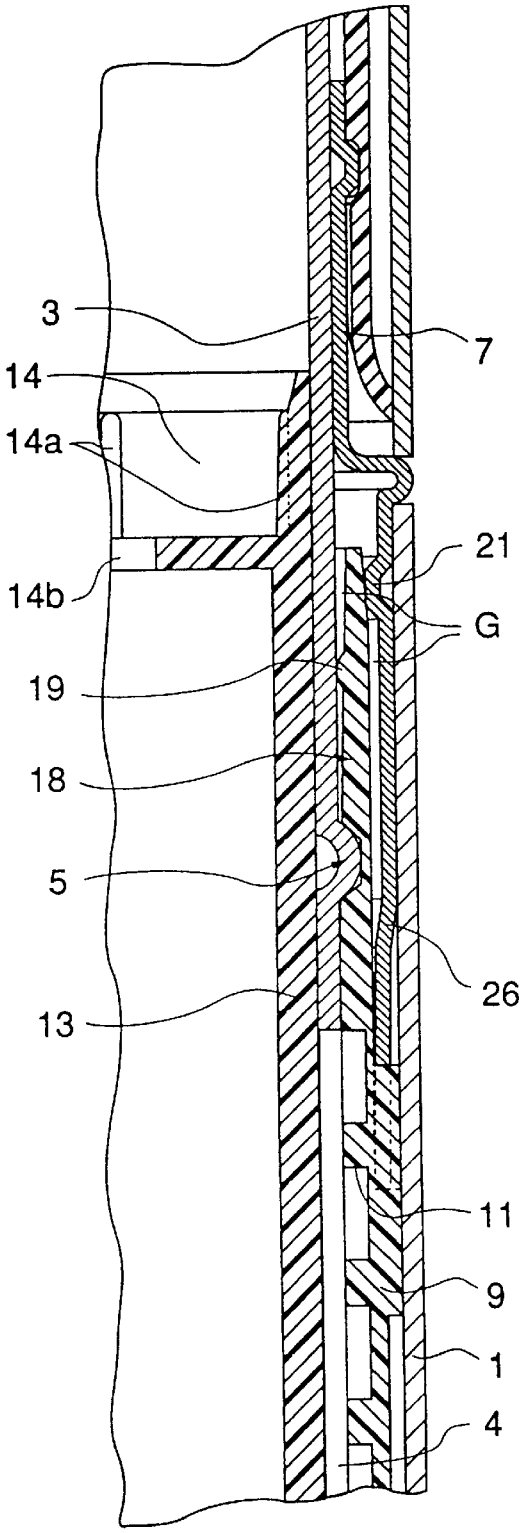
FIG. 3 is an enlarged view showing M portion of a modified embodiment.

FIG. 3 shows another embodiment of the active portion. In this embodiment, active portion 18 is formed extensively between from the upper end of outer body 9 and a position just below the abutment 5.

Figure 4:
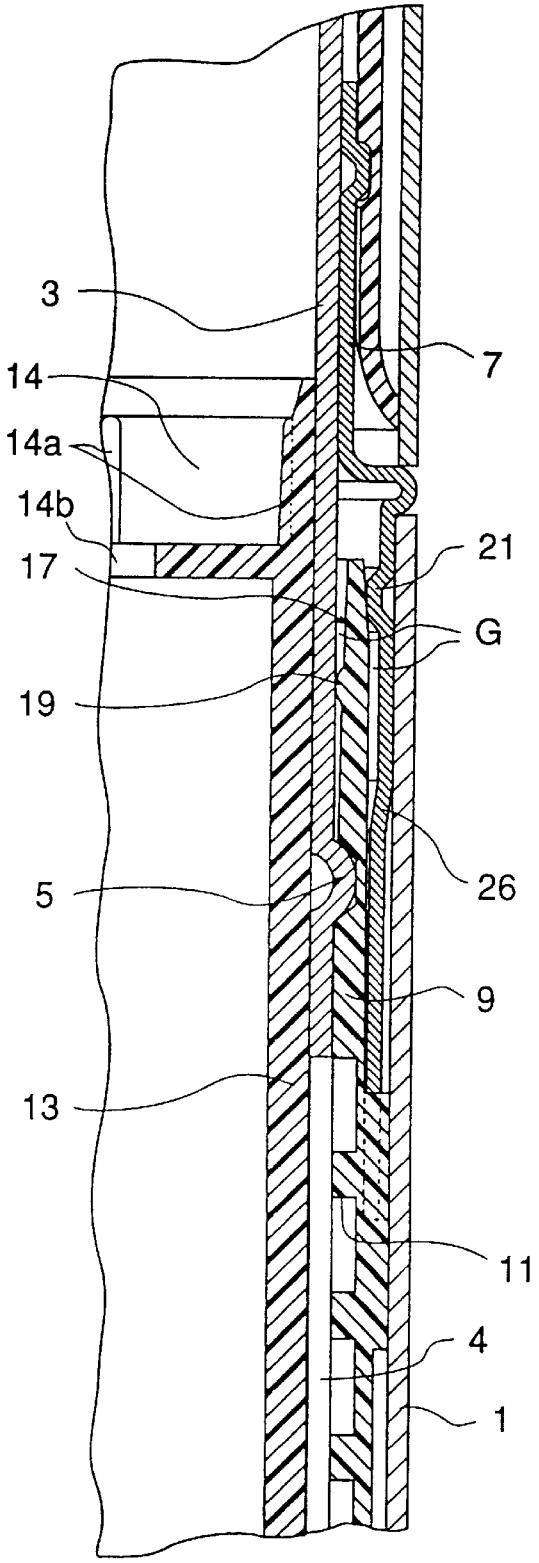
FIG. 4 is an enlarged view showing M portion of another modified embodiment.

The lower portion 26 of insert sleeve 7 may have a gradually reduced diameter to achieve contact with the lower end portion of the active portion, as shown in FIGS. 3 and 4.

Figure 5A:
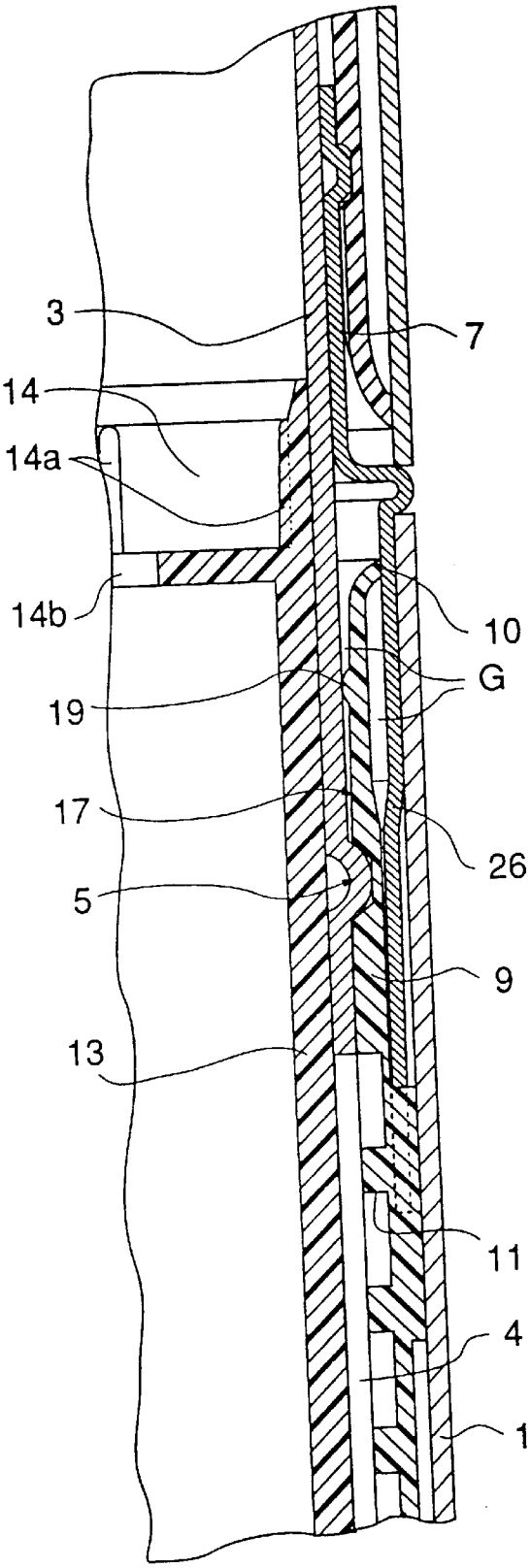
FIGS. 5A and 5B are enlarged views showing M portion of still another embodiment.
Figure 5B:
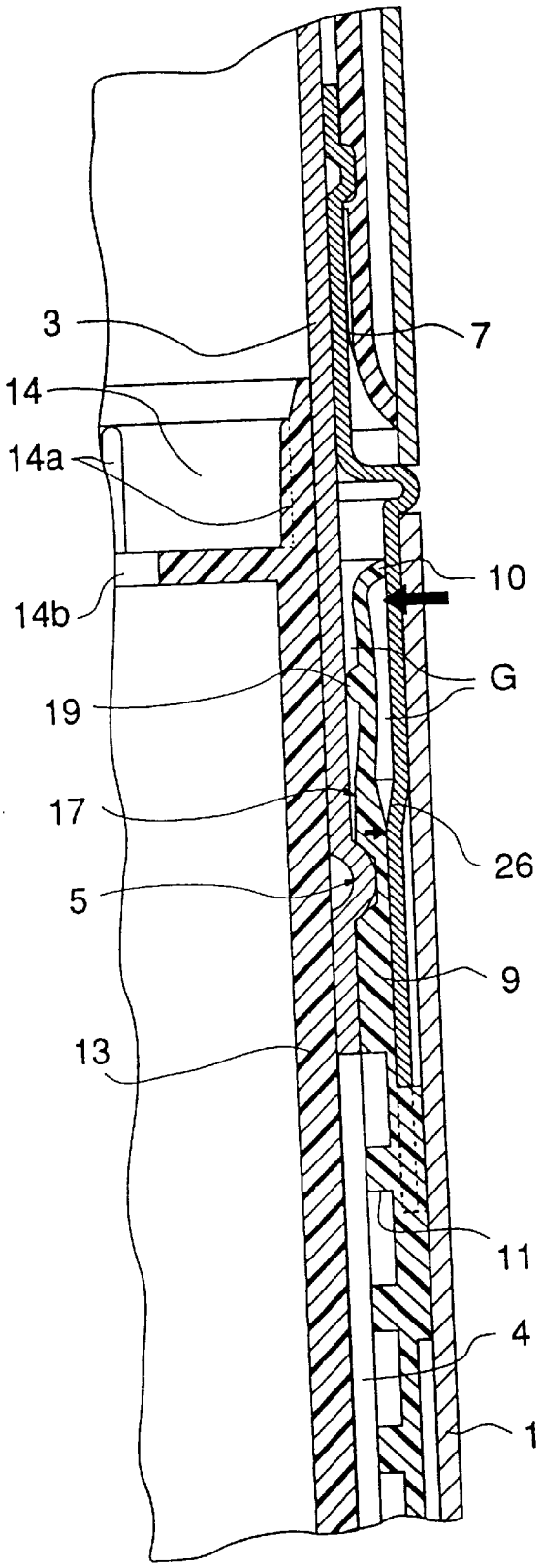

In place of projection 21 of insert sleeve 7, the top end 10 of active portion 17 is enlarged to be in contact with the inner peripheral surface of insert sleeve 7, as shown in FIG. 5. In this example, the same operation and effects can be likewise achieved, as clearly shown in FIG. 5B.

Figure 6A:
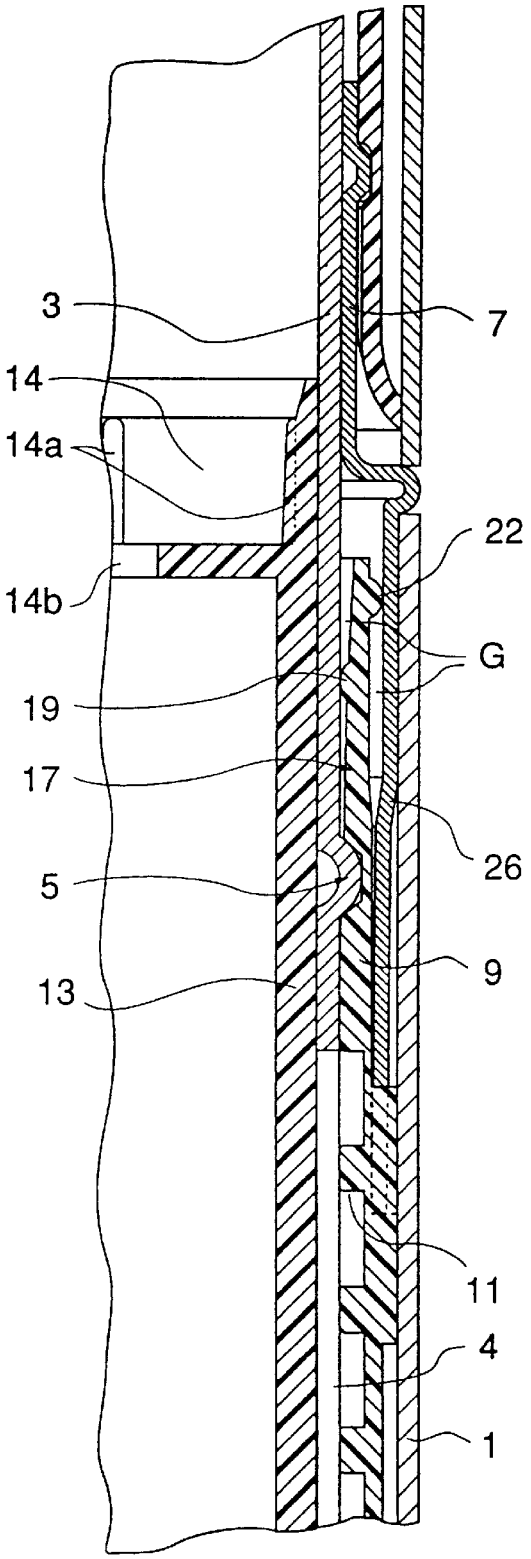
FIG. 6 is an enlarged view showing M portion of still another embodiment.
Figure 6B:
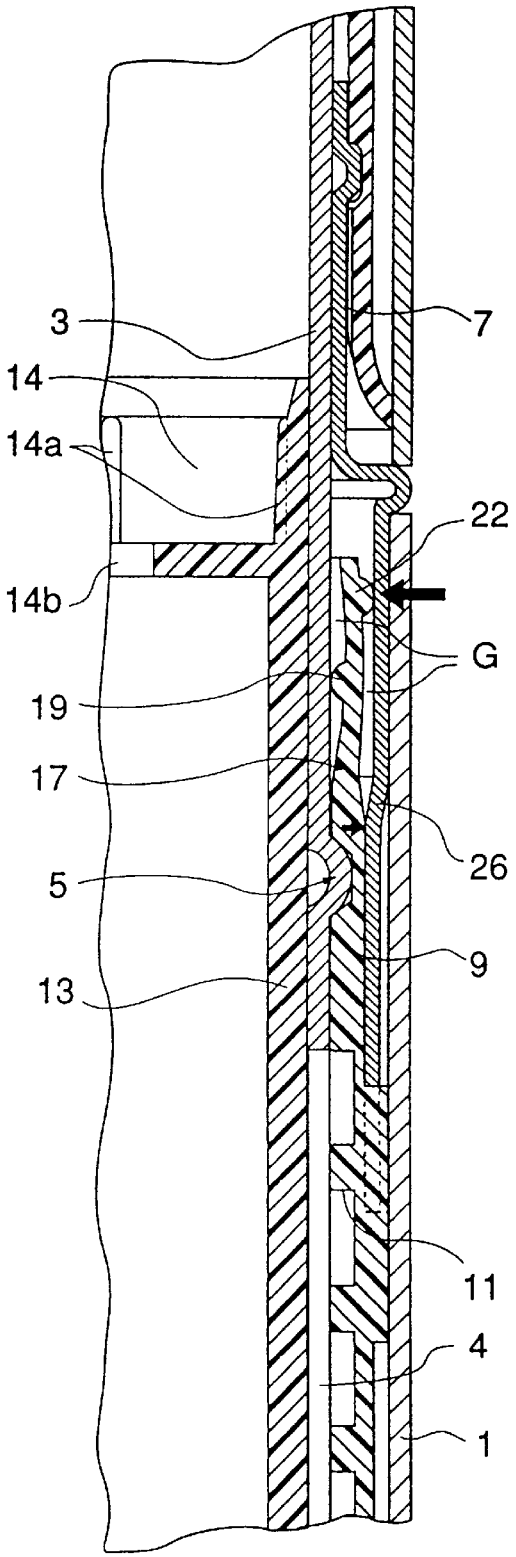

Projection 21 of insert sleeve 7 may further be replaced by a projection 22 annually formed on the outer peripheral surface of the upper end of active portion 17, for contacting with the inner peripheral surface of insert sleeve 7, as shown in FIG. 6. Projection 22 may be an endless continuous one or formed as a series of spaced, annually arranged dot-like projections. In this example, the same operation and effects can be likewise achieved, as clearly shown in FIG. 6B.

When the lower portion 26 of insert sleeve 7, which is located corresponding to the lower end of active portion 17, is bent and engaged with the outer peripheral surface of outer body 9, as shown in FIGS. 3 to 7, insert sleeve 7 can be tightly fitted to main body 3 and outer body 9 respectively, thereby effectively improving airtightness of the container and preventing separation or drawing of main body 3.

The embodiment shown in FIG. 7 has a circumferentially inward projecting bead-like projection 19, which enhances the spring effects of active portion 17.

Figure 8:
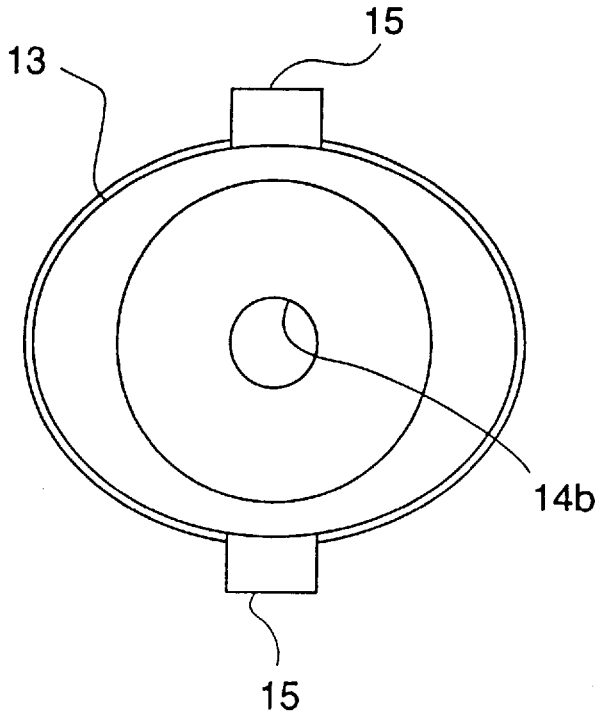
FIG. 8 is a transverse cross-sectional view showing another embodiment of a cosmetic holder for use in the cosmetic container of the present invention.
Figure 9A:
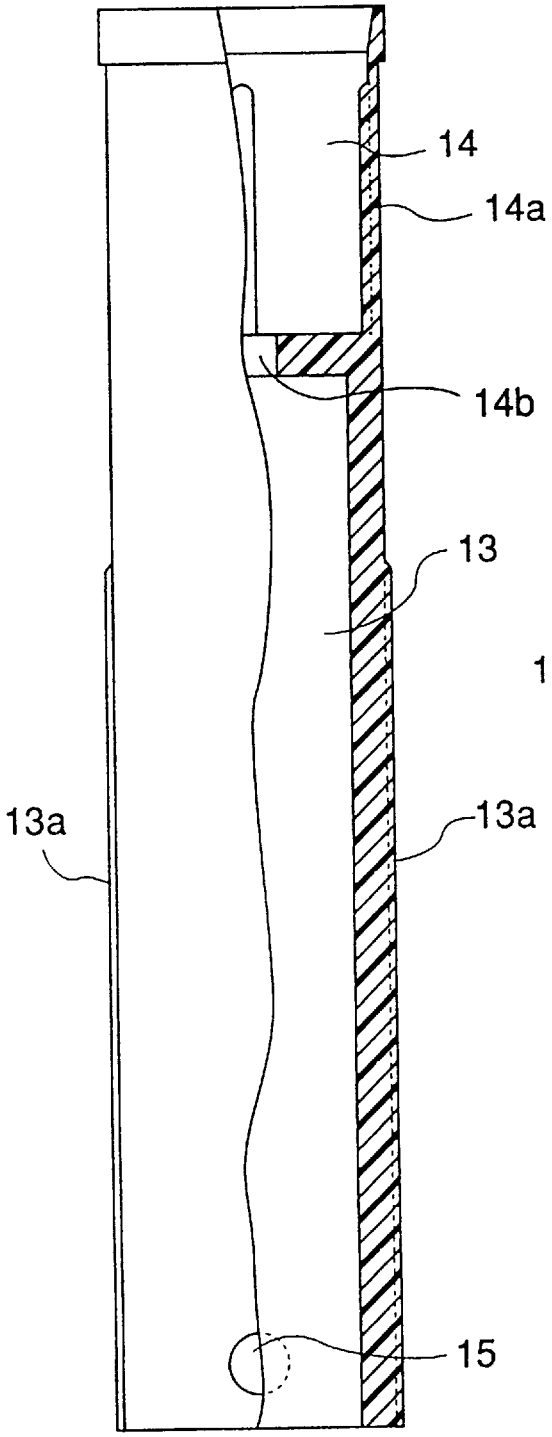
FIGS. 9A and 9B are longitudinal and transverse cross-sectional views showing still another embodiment of the cosmetic holder.
Figure 9B:
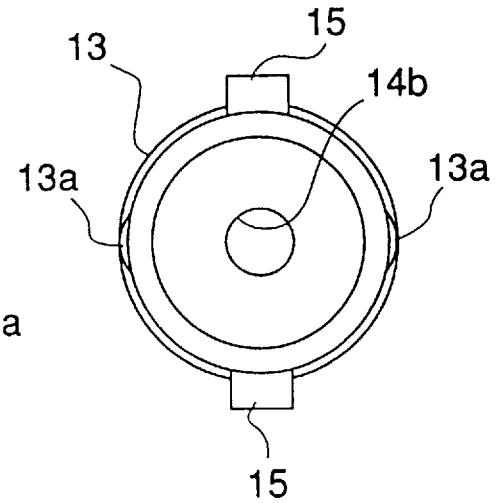
Figure 10A:
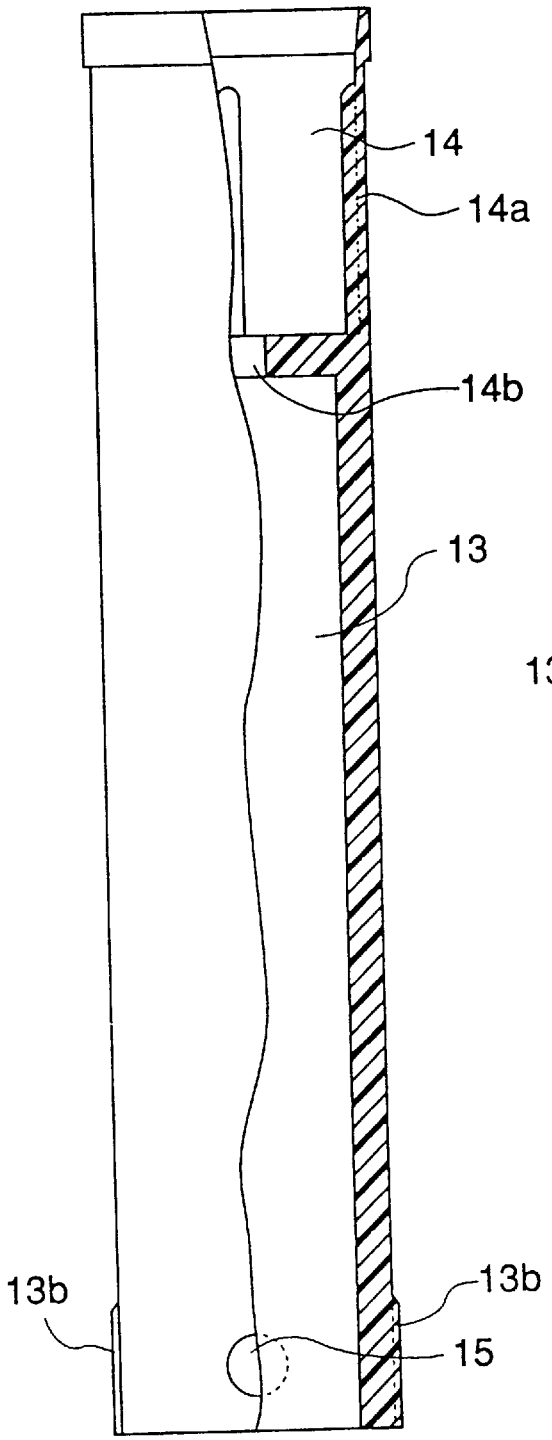
FIGS. 10A and 10B are longitudinal and transverse cross-sectional views showing still another embodiment of the cosmetic holder.
Figure 10B:
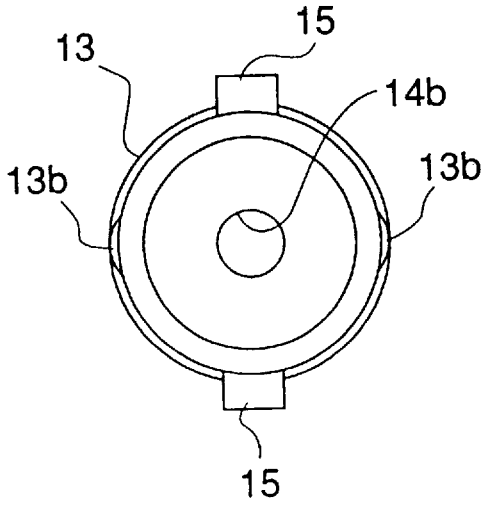
Figure 11A:
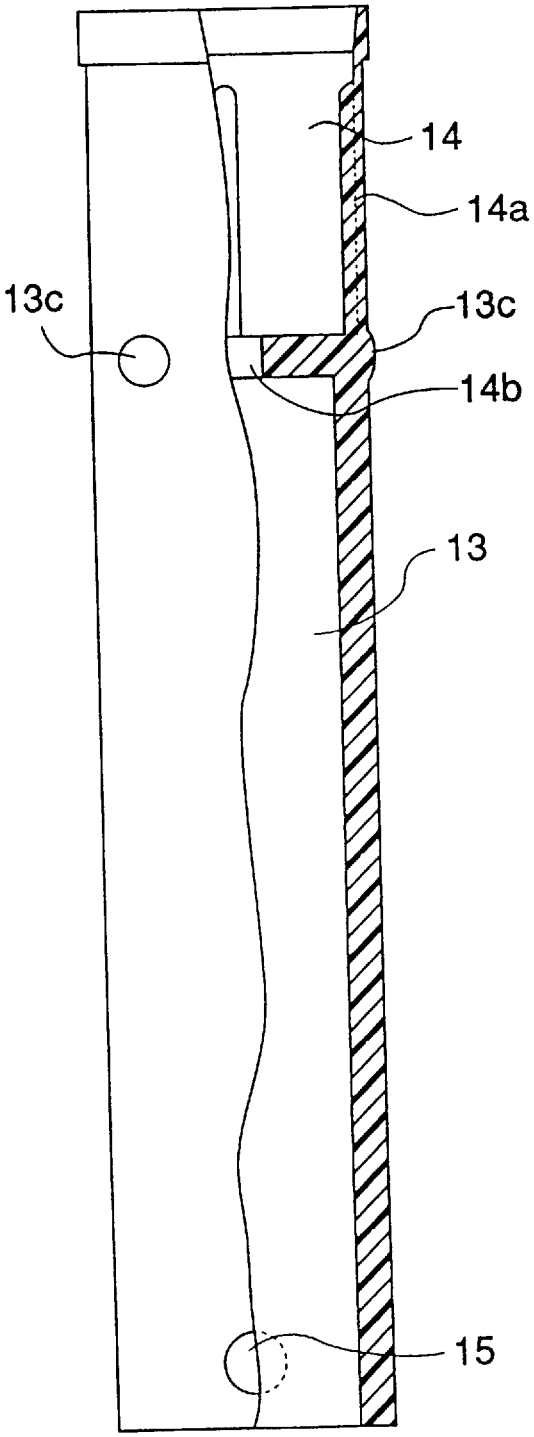
FIGS. 11A and 11B are longitudinal and transverse cross-sectional views showing still another embodiment of the cosmetic holder.
Figure 11B:
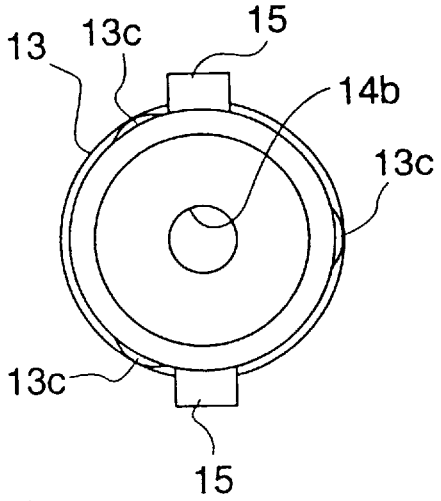

Cosmetic holder 13 may have a desired shape and form. For example, it may be an oval in cross-section (FIG. 8). It may be provided with a pair of opposed projections 13*a*, 13*a* extending longitudinally along the outer peripheral surface thereof (FIG. 9). Alternatively, longitudinally extending projections may be positioned only at the lower end of cosmetic holder 13, which are shown as projections 13*b*, 13*b* in FIG. 10. Spaced projections 13*c* may be formed on the outer peripheral surface of the bottom of receptacle 14 (FIG. 11).

Figure 12:
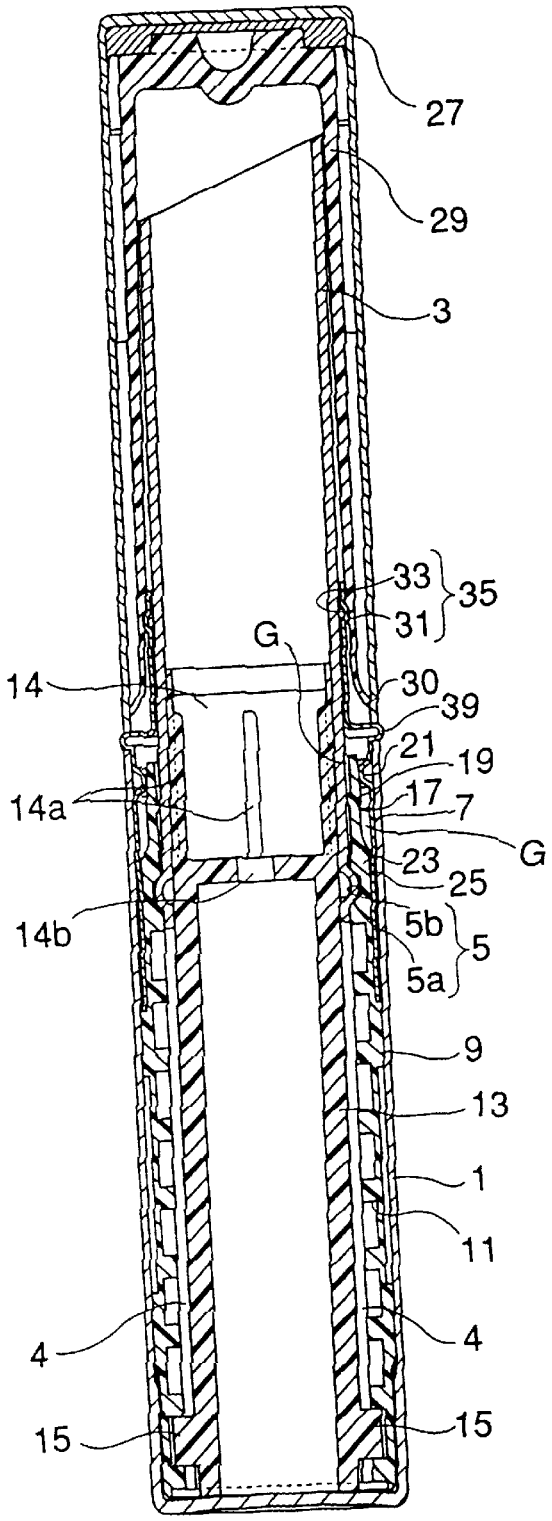
FIG. 12 is a longitudinal cross-sectional view showing the cosmetic container according to still another embodiment of the present invention.
Figure 13:
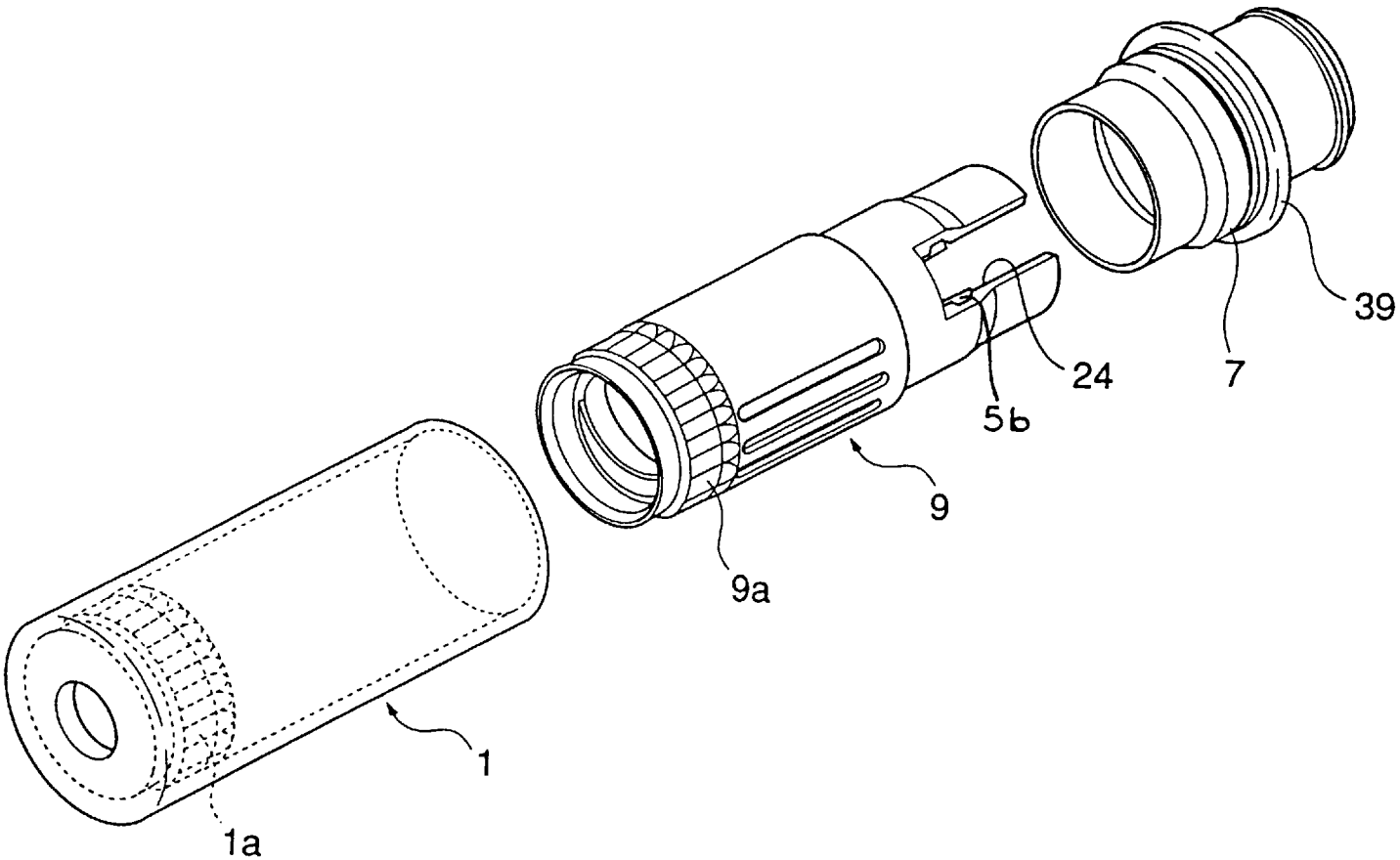
FIG. 13 is an exploded perspective view showing the relationship between the casing, the outer body and the insert sleeve in the cosmetic container of FIG. 12.

Suitable stop means may be employed for preventing relative rotation between adjacent members. For example, FIGS. 12 and 13 show rotation-stopper for preventing relative rotation between outer body 9 and casting 1. In this embodiment, the lower end portion 9*a* of outer body 9 has a polygonal outer shape in cross-section, which is received within the lower end portion 1*a* of casing 1 having a complementary cross-sectional bore shape. Rotation-stopper may otherwise comprise a combination of complementary rugged surfaces or a combination of longitudinal rib(s) and slot(s) receiving the rib(s), one formed on the outer peripheral surface of outer body 9 and the other on the inner peripheral surface of casing 1.

Figure 14:
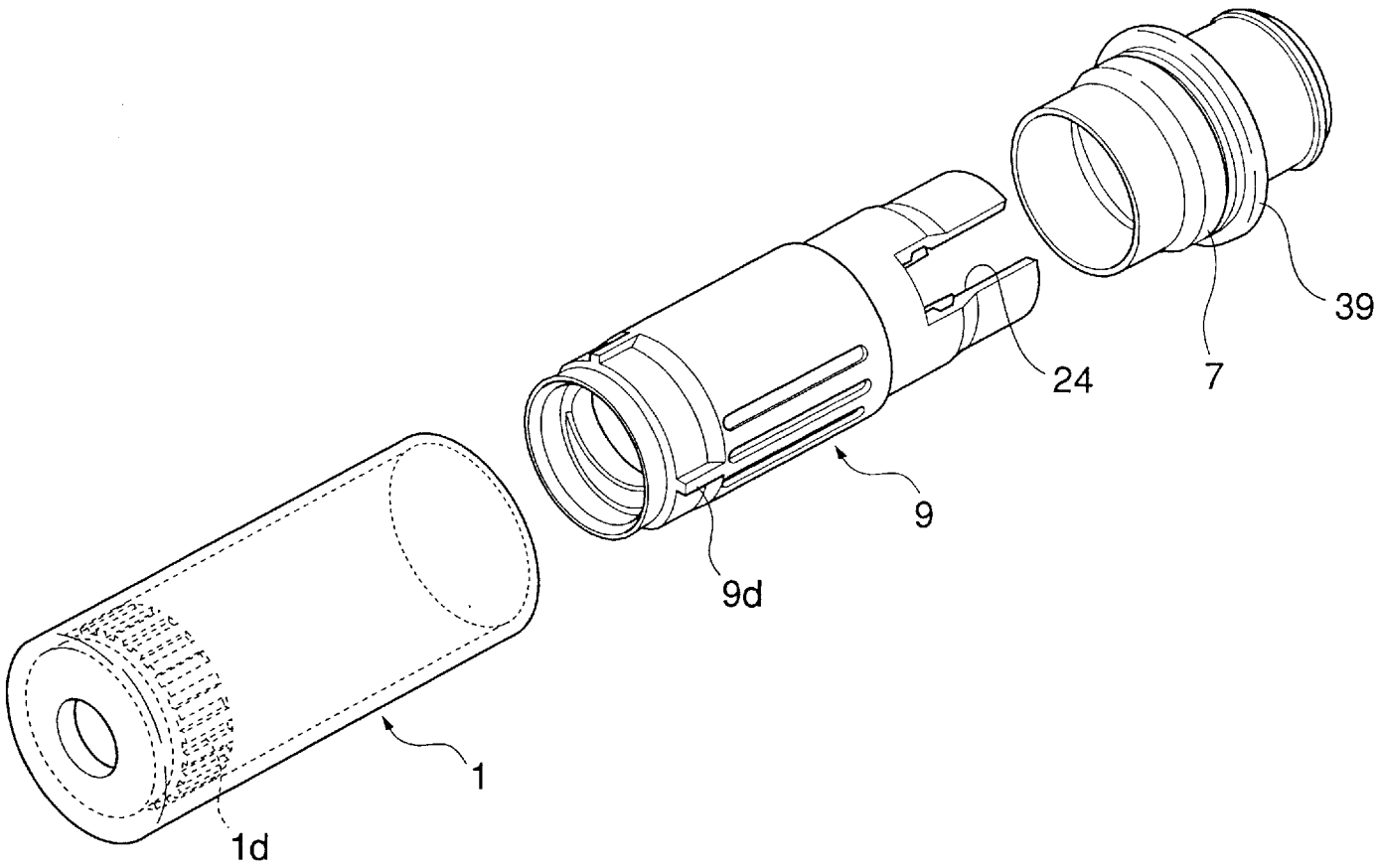
FIG. 14 is an exploded perspective view showing another embodiment of the relationship between the casing, the outer body and the insert sleeve.

FIG. 14 is a modification of the embodiment of FIG. 12. This modification provides rotation-stopper comprising such that the outer peripheral surface of the base portion of outer body 9 is provided with stripe projections 9*d* for engaging with grooves 1*d* of corresponding shape formed on the inner peripheral surface of the base portion of casing 1.

Figure 15:
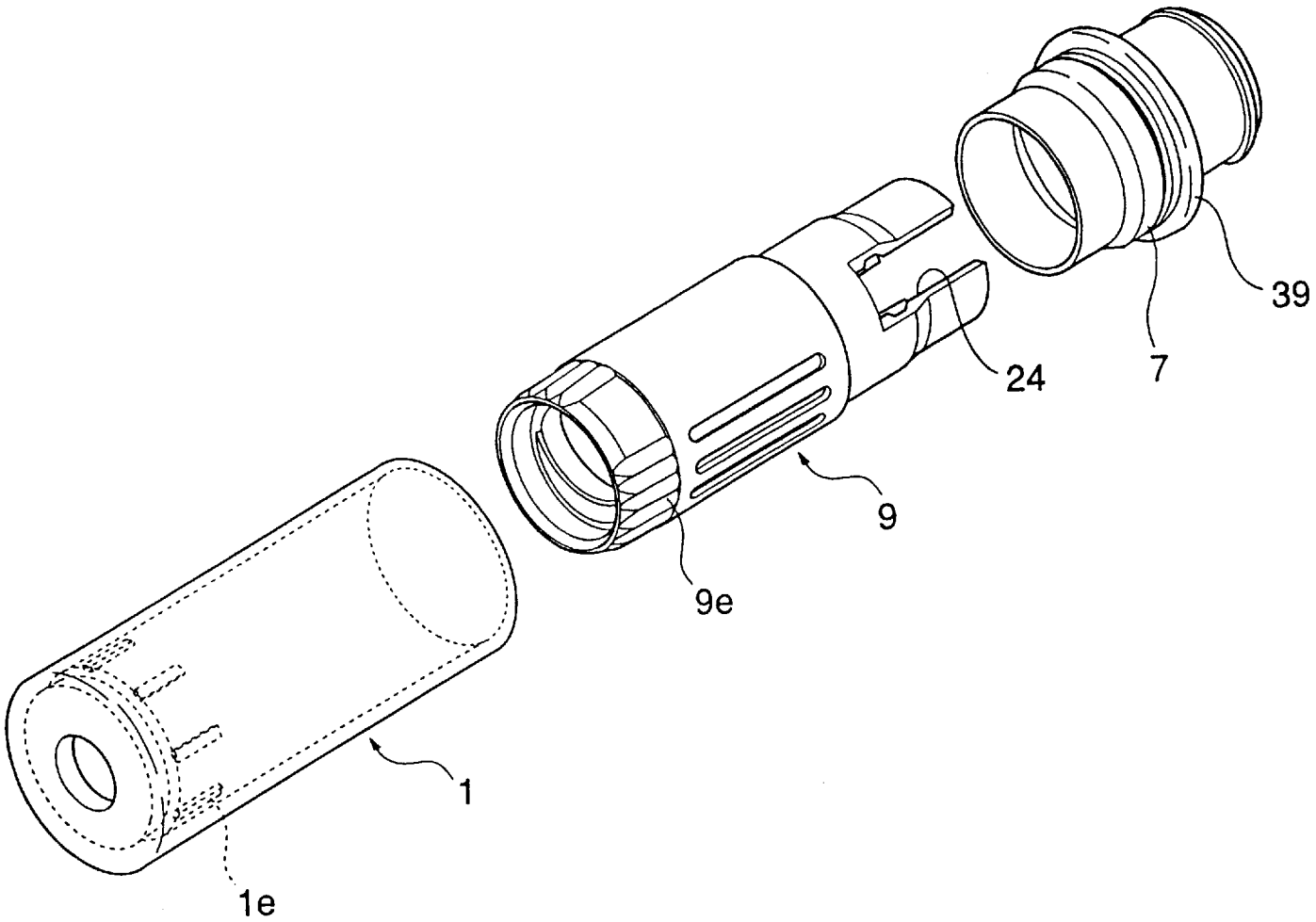
FIG. 15 is an exploded perspective view showing still another embodiment of the relationship between the casing, the outer body and the insert sleeve.

FIG. 15 shows another modification of rotation-stopper. In this case, stripe projections le is formed on the inner peripheral surface of the base portion of casing 1, which is engageable with some of grooves 9*e* formed on the outer peripheral surface of the base portion of outer body 9.

Figure 16:
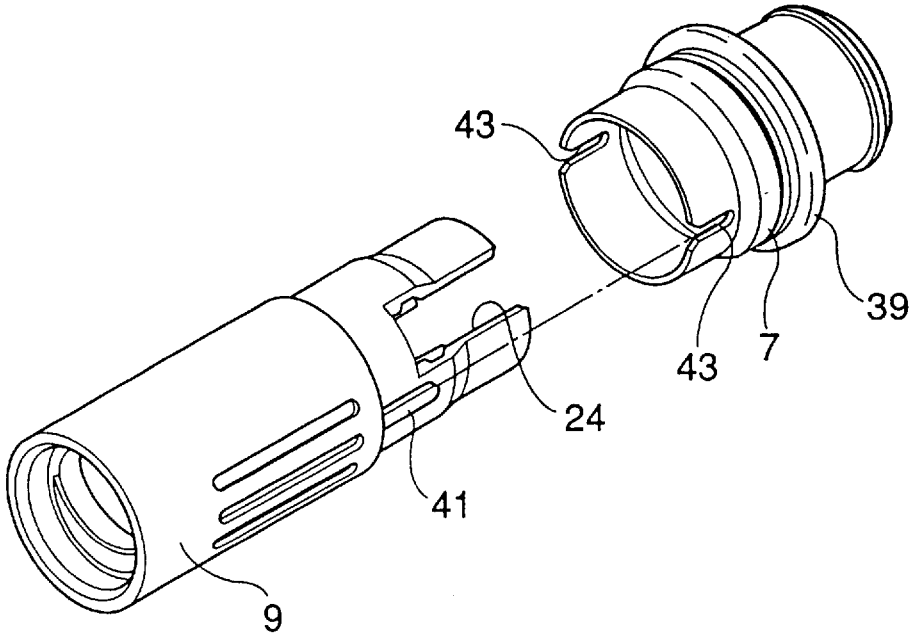
FIG. 16 is an exploded perspective view showing the relationship between an insert sleeve and the outer body in another embodiment of the present invention.

FIG. 16 shows an example of rotation-stopper between insert sleeve 7 and outer body 9, which comprises a combination of a pair of opposed longitudinal projections 41, 41 formed on the outer peripheral surface of outer body 9 and a pair of opposed slits 43, 43 formed at the lower end of insert sleeve 7 for receiving projections 41, 41.

Figure 17:
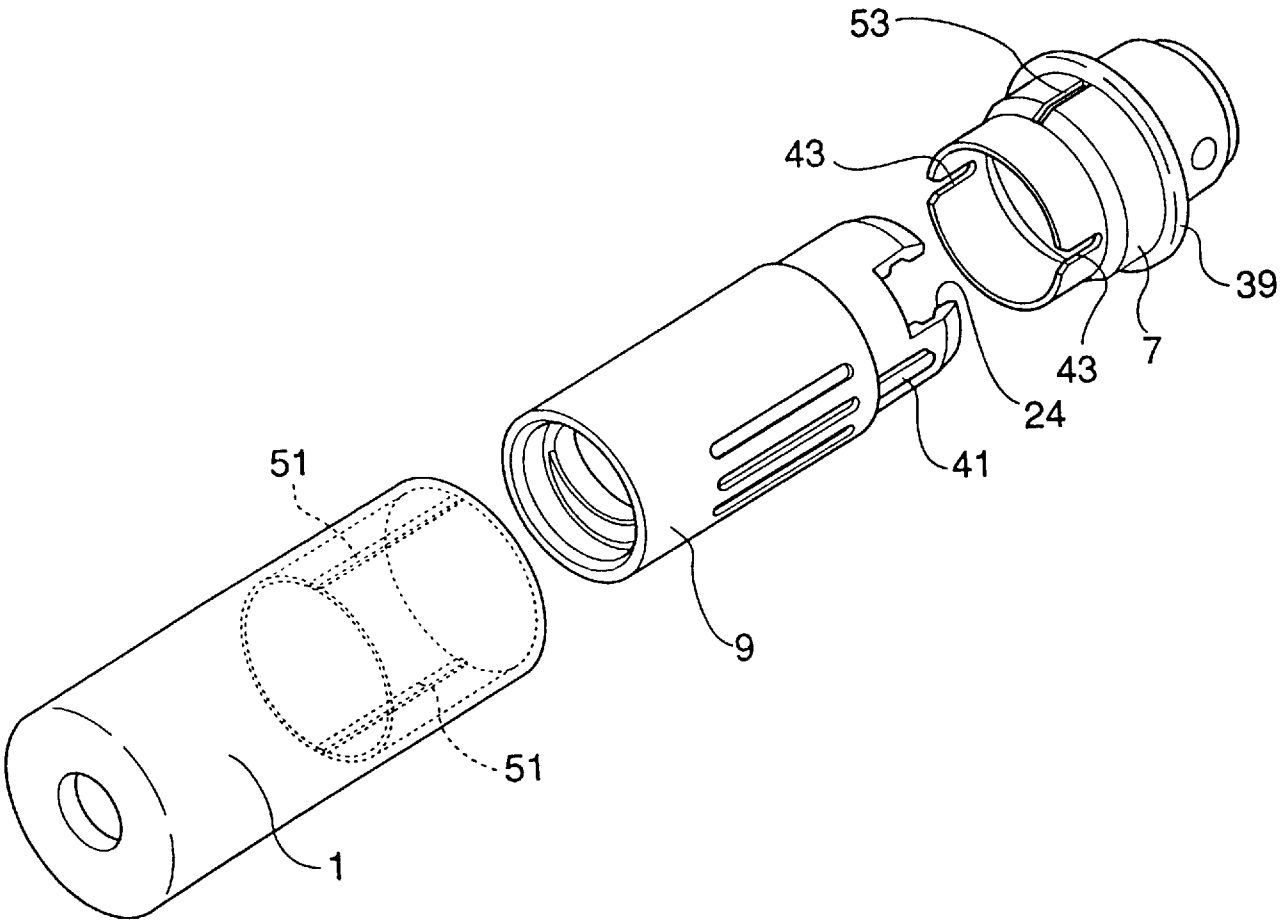
FIG. 17 is an exploded perspective view showing the relationship between the casing, the outer body and the inset sleeve in still another embodiment of the present invention.

FIG. 17 shows an embodiment having a combination of a first rotation-stopper between outer body 9 and insert sleeve 7 and a second rotation-stopper between casing 1 and insert sleeve 7. More particularly, there are opposed projections 41, 41 and receiving slits 43, 43, in the same manner as shown in FIG. 16, to form the first rotation-stopper. The second rotation-stopper comprises inner projections 51, 51 of casing 1 which are engageable with slits 53, 53 of insert sleeve 7.

Figure 19A:
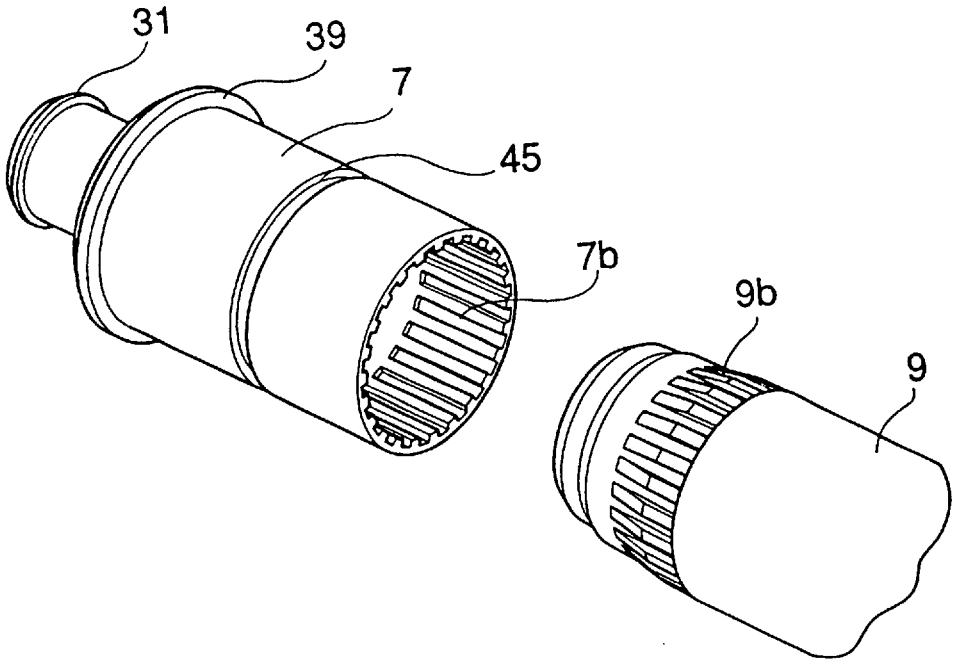
FIGS. 19A and 19B are exploded perspective views showing examples of the relationship between the insert sleeve and the outer body in the cosmetic container of FIG. 18.
Figure 19B:
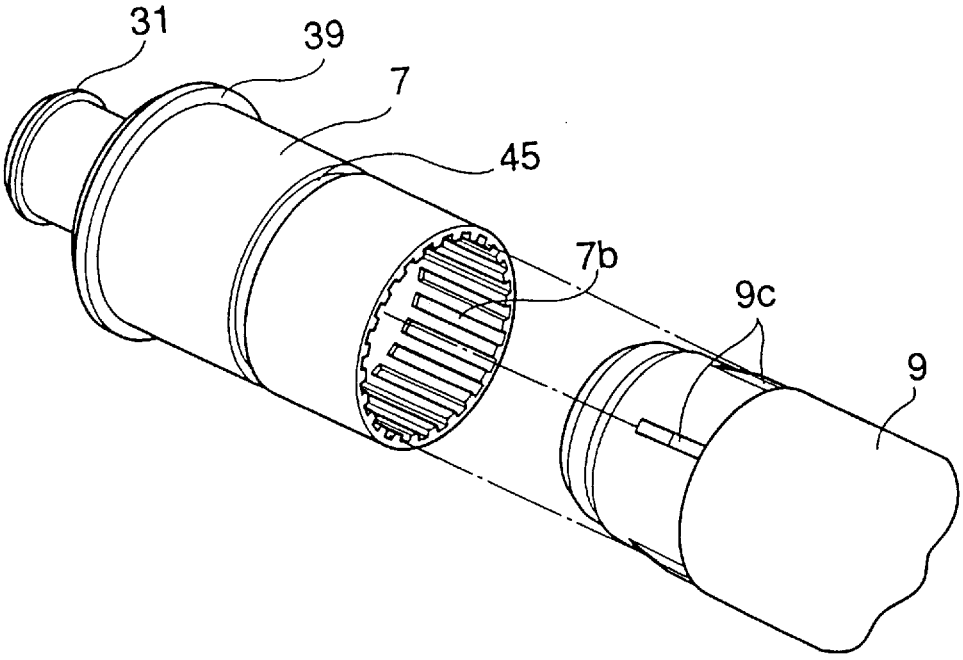

Some embodiments of rotation-stopper between insert sleeve 7 and outer body 9 are shown in FIGS. 18 and 19. FIGS. 18A and 18B are longitudinal cross-sectional views taken along vertical planes perpendicular to each other; FIG. 18C is a transverse cross-sectional view taken along a line C—C in FIG. 18A; FIG. 18D is a transverse cross-sectional view taken along a line D—D in FIG. 18A; and FIG. 18E is a transverse cross-sectional view taken along a line E—E in FIG. 18A. As particularly shown in FIG. 18A, the lower end portion of the insert sleeve 7 is provided with a plurality of internal knurls 7*b*, which engages with corresponding knurls 9*b* formed on the outer peripheral surface of the upper end portion of outer body 9. Knurls 9*b* may be replaced by several projections, as shown in FIG. 19B. Although not specifically shown, knurls 7*b* may also be replaced by longitudinally extending projections.

In this embodiment, insert sleeve 7 is made of resin such as acrylonitrile styrene copolymer (AS resin), acrylonitrile butadiene styrene copolymer (ABS resin) and polypropylane (PP), and metal coating such as gold plating is applied to its surface. An annular ring 45 such as nitrile butadiene copolymer rubber (NBR), low-density polyethylene (LDPE) etc. may be press-fit to insert sleeve 7 to improve airtightness between insert sleeve 7 and casing 1, as shown in FIGS. 19A and 19B.

Casing 1, main body 3 and cap 27 are made of aluminum, outer body 9 is made of polyacetal (POM), holder 13 is made of polypropylane (PP) and inner cap 29 is made of linear low-density polyethylene (L-LDPE).

FIG. 18 also discloses a modification of projection formed on the inner peripheral surface of insert sleeve 7. Namely, a projection 21*a* is simply formed by increasing a thickness of insert sleeve 7.

Although the above-described embodiments show a cosmetic container of an insertion type in which a solid cosmetic is inserted from the above into receptacle 14, the present invention can also be applied to another type cosmetic container in which a molten cosmetic is filled into a mold located in receptacle 14 from the above (direct-filling type) or through an aperture in the bottom of casing 1 (bottom-filling type). After the cosmetic is solidified, the mold is removed and the cap assembly is fitted onto casing 1.

Figure 20:
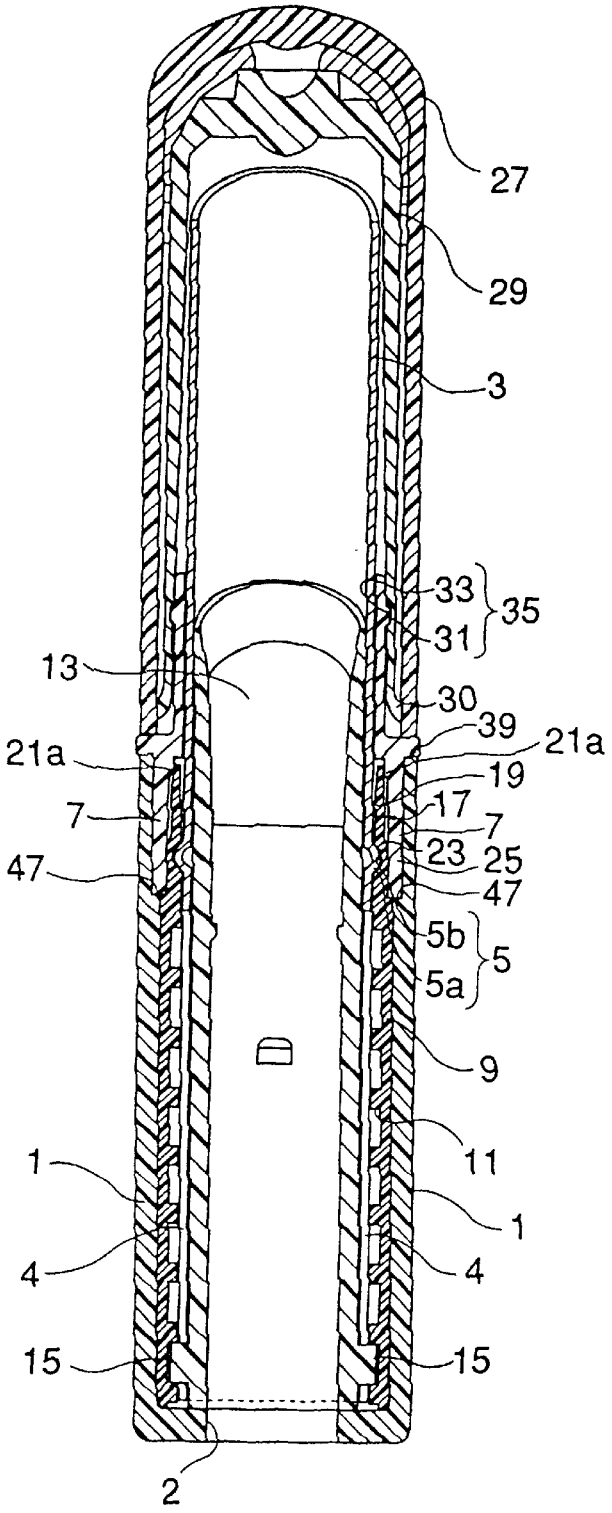
FIG. 20 is a longitudinal cross-sectional view showing the cosmetic container according to still another embodiment of the present invention.

FIG. 20 shows an embodiment wherein the present invention is applied to a cosmetic container of a bottom-filling type in which a molten cosmetic is filled through an aperture 2 in the bottom of casing 1. In this case, cosmetic holder 13 is a hollow tube having upper and lower open ends. After the cosmetic is solidified, a seal is adhered to aperture 2 to create and maintain an airtight condition within the container.

Figure 21:
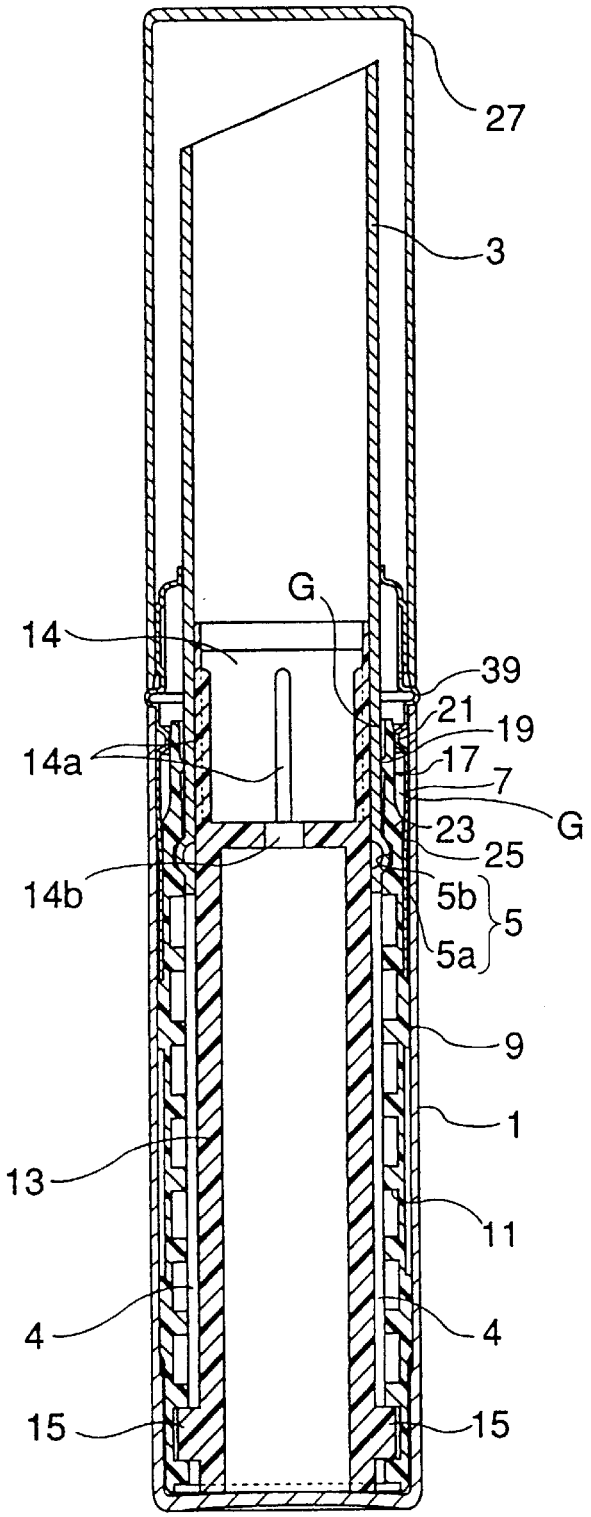
FIG. 21 is a longitudinal cross-sectional view showing the cosmetic container according to still another embodiment of the present invention.

In the case of a container of a direct-filling type, there is no aperture 14*b* in the bottom of receptacle 14. In the filling type container, projections 14*a* formed on the inner peripheral surface of receptacle 14 may extend axially (as shown in FIG. 21) or annularly.

Figure 22A:
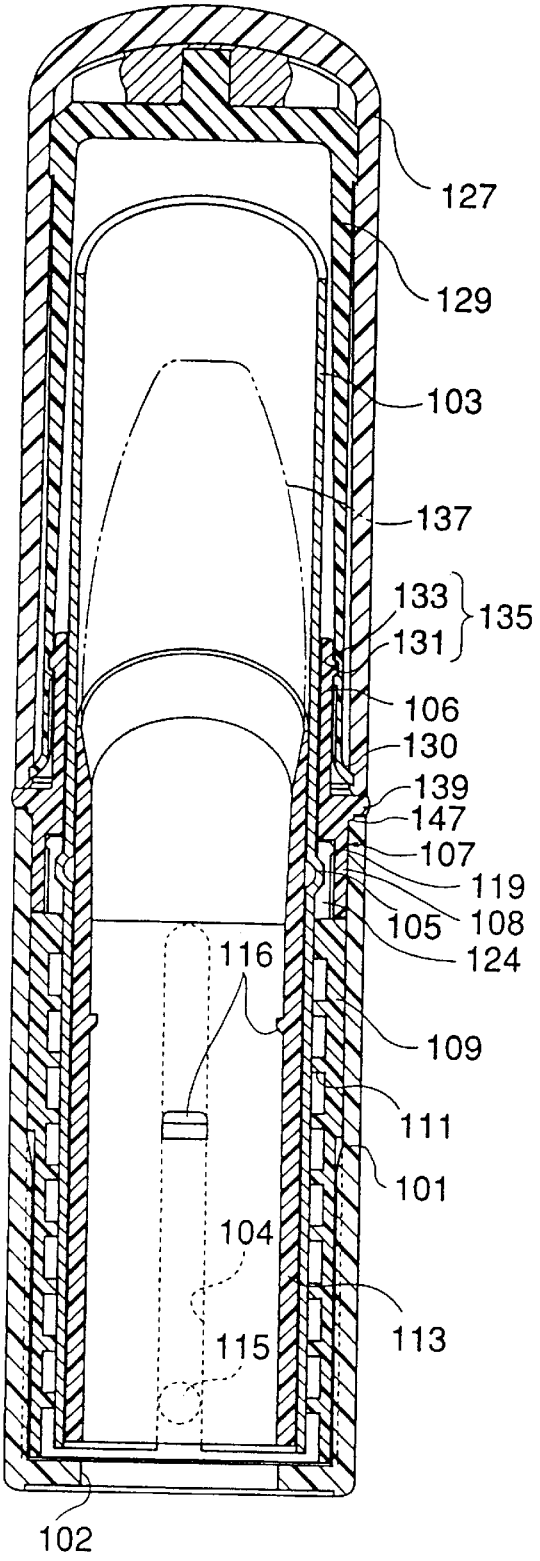
FIG. 22A and 22B are longitudinal cross-sectional views showing the cosmetic container according to still another embodiment of the present invention.
Figure 22B:
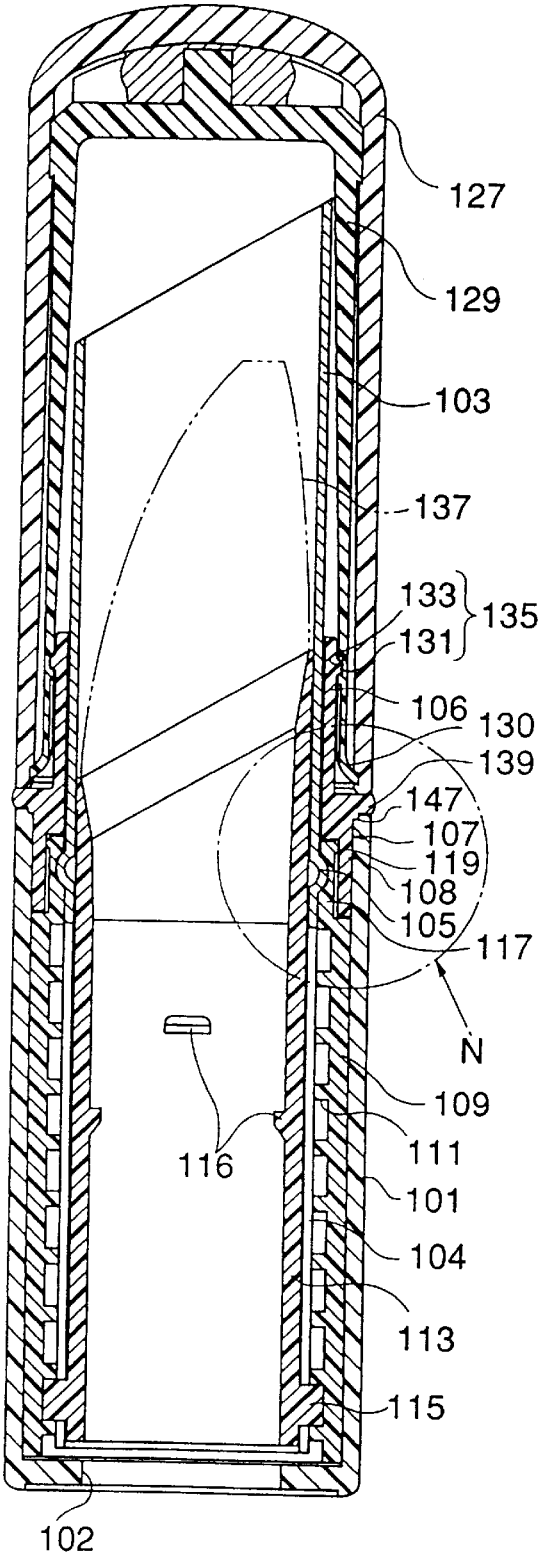

Still another embodiment according to the present invention will be described with reference to FIGS. 22 and 23. FIGS. 22A and 22B are longitudinal cross-sectional views taken along vertical planes perpendicular to each other.

A cylindrical cosmetic container of this embodiment includes a cylindrical casing 101 having an upper open end and a lower closed end with a bottom aperture 102, and a main body 103 coaxially arranged and received within casing 101 with some diametrical gap therebetween. Main body 103 is made of a straight pipe formed by drawing etc., having upper and lower open ends and the same diameter over its entire length except bead 105. A pair of opposed elongated slots 104 are provided in symmetrical location of the lower portion of main body 103.

Main body 3 has a center portion having a circumferentially projecting external bead 105, which cooperates with an annular groove 120 formed at an upper portion of an outer body 109 to form an abutment 105 between main body 103 and outer body 109. Outer body 109 may be rotated with respect to main body 103, while preventing separation therebetween by means of abutment 105. At least one slit 124 is formed at the upper portion of outer body 109 to aid in coupling outer body 109 to main body 103 by aiding in the temporary deformation of the upper portion of outer body 109.

An insert sleeve 107 is located between main body 103 and casing 101. More particularly, the upper portion of insert sleeve 107 airtightly encircles main body 103 and its lower portion is interposed between outer body 109 and casing 101. Outer body 109 is fitted within casing 101. Thus, casing 101, insert sleeve 107 and outer body 109 are assembled in one united body and in use moved in unison.

An elevatable cosmetic holder 113 is encapsulated by main body 103 for receiving a stick-like cosmetic 137. On the outer peripheral surface of cosmetic holder 113 at the lower end therof, there is integrally formed a pair of opposed projections 115, 115 which project outwardly to pass through slots 104 and engage with a continuous spiral groove 111 formed on the inner peripheral surface of outer body 109. Spiral groove 111 is located beneath annular groove 120.

Figure 23:
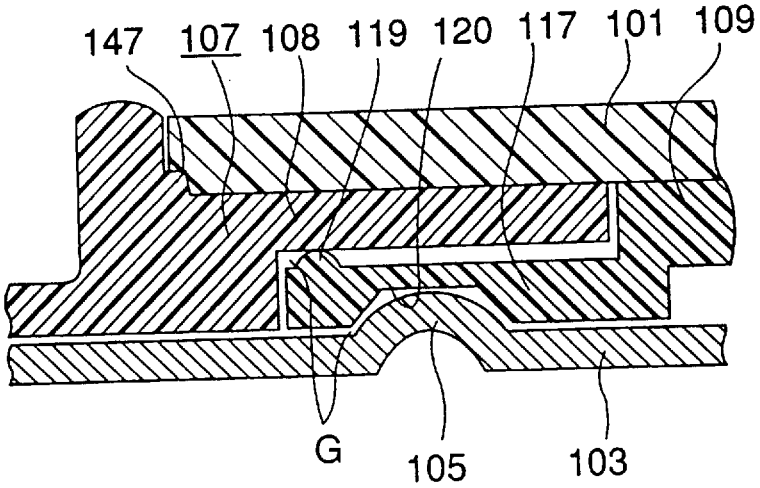
FIG. 23 is an enlarged view showing an N portion in FIG. 22.

In further reference to FIG. 23, outer body 109 extends upwardly to form an integral active portion 117 which terminates at a location just above annular groove 120. Active portion 117 can elastically move within a space between the lower portion 108 of insert sleeve 107 and main body 103.

More particularly, active portion 117 is provided at its inner peripheral surface with an annular groove 120 for encircling and engaging with external bead 105 of main body 103. At the upper end portion of the outer peripheral surface, active portion 117 is provided with an endless annular projection 119 for contacting with the inner peripheral surface of the lower extension 108 of insert sleeve 107. Active portion 117 has gaps G between main body 103 and insert sleeve 7, respectively. Insert sleeve 107 is ultrasonic-welded to the top portion 147 of casing 101.

A cap 127 has an inner cap 135 fitted thereto having an annular recess 133 which cooperates with an annular external projection 131 integrally formed on the top portion of insert sleeve 107 to form detachable coupling means 135 between inner cap 129 and insert sleeve 107. The lower end 130 of inner cap is spread outwardly, which makes it easier to attach and detach the cap assembly with respect to insert sleeve 107 (or cosmetic container itself). An intermediate large-diameter bead portion 139 of insert sleeve 107 is located on the upper end rim of casing 101 for mounting cap 127 thereon.

In the above-described embodiment, the cosmetic 137 is filled through aperture 102 of the bottom of casing 101 into a suitable mold placed in cosmetic holder 113. Namely, the cosmetic container of this embodiment is of a bottom-filling type. After filling the cosmetic 137, aperture 102 is closed and air-sealed by suitable sealing means. After the cosmetic 137 has been solidified, the mold is removed and the cap assembly is fitted onto casing 1.

By way of example, casing 101, insert sleeve 107 and cap 127 are made of acrylonitrile stylene copolymer (AS resin), and main body 103 is made of metal such as aluminum. Outer body 109, cosmetic holder 113 and inner cap 129 may be made of thermoplastic resin such as polyacetal (POM), polybutylene terephthalate (PBT) and linear low-density polyethylene (L-LDPE), respectively.

With the above-described cosmetic container, active portion 117 acts like a spring and is elastically deformed within a space between main body 103 and insert sleeve 107 which could be changed by inaccuracy or manufacturing errors of diameters of elements constituting the cosmetic container. The space between main body 103 and insert sleeve 107 could also be deformed or changed during extraction or retraction of cosmetic holder 113.

Figure 24:
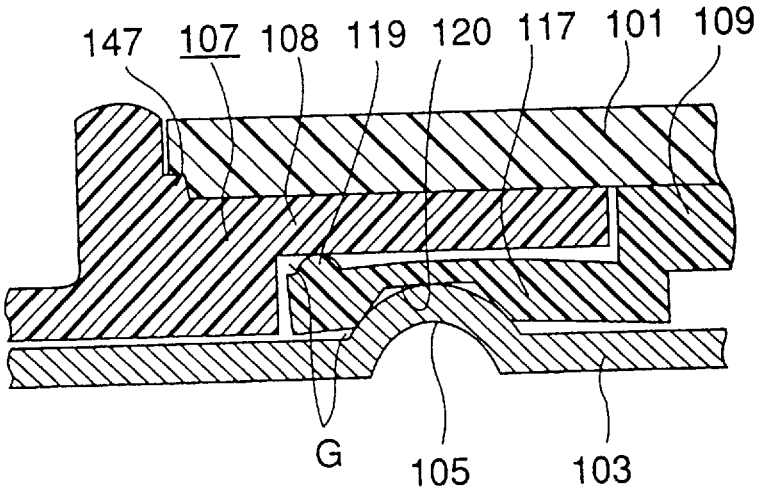
FIGS. 24 to 26 are enlarged views showing N portion for explaining the function of the cosmetic container of FIG. 22.

More particularly, FIG. 24 shows a relationship between elements when external bead 105 of main body 103 projects outwardly toward lower portion 108 of insert sleeve 107 to some greater extent, rather than in a case shown in FIG. 23. Accordingly, there is a narrower space between main body 103 and lower portion 108. Such a relationship would result from inaccuracy in manufacturing main body 103 with bead 105 or material deformation during extraction or retraction. In this case, active portion 117 is elastically deformed within the space so that bead 105 is almost completely received within groove 120 with contact with three walls thereof.

During extraction or retraction of the cosmetic holder 113 which is achieved by engagement between projection 115 and spiral groove 111, main body 103 and outer body 109 tend to move in a vertical direction with respect to each other. Such displacement between main body 103 and outer body 109 could also be caused by manufacturing errors.

Figure 25:
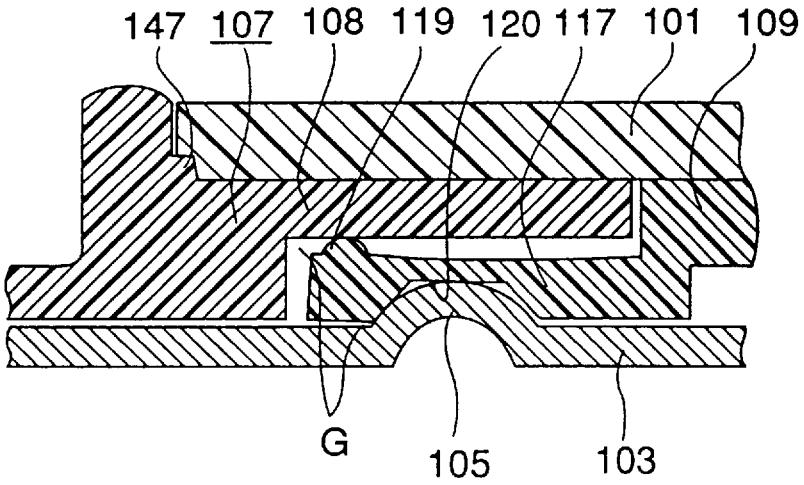

FIG. 25 shows a relationship between main body 103 and outer body 109 wherein main body 103 is positioned upwardly with respect to outer body 109. External bead 105 contacts with the upper two walls of groove 120 and active portion 117 is deformed accordingly. Although not shown, when main body 103 is displaced more upwardly with respect to outer body 109, bead 105 will contact only with the uppermost wall of groove 120.

Figure 26:
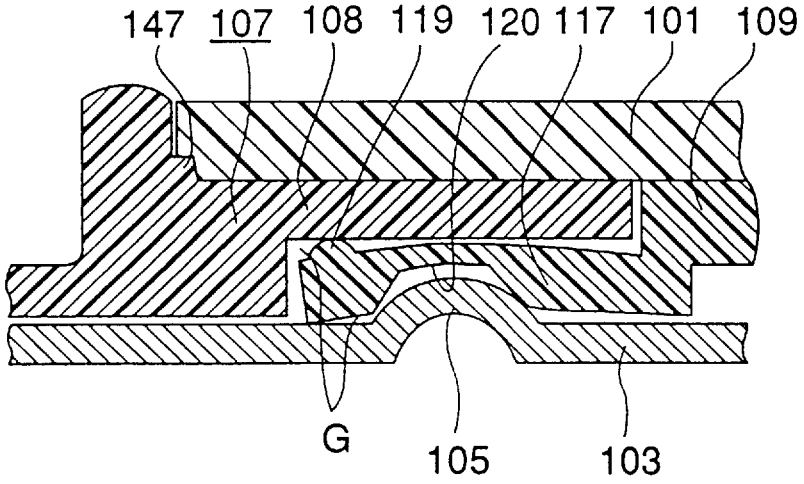

FIG. 26 shows a relationship wherein main body 103 is positioned downwardly with respect to outer body 109. Bead 105 contacts with the lowermost wall of groove 120 and active portion 117 is deformed accordingly. Although not shown, when a degree of downward displacement of main body 103 is smaller than that shown in FIG. 26, bead 105 will contact with the lower two walls of groove 120.

In all cases, active portion 117 contacts with the lower portion 108 of insert sleeve 107 at rib 119, which facilitates elastic deformation of active portion 117.

As above-described, active portion 117 is elastically deformed within the space between main body 103 and lower position 108 of insert sleeve 107, thereby compensating for manufacturing errors of constituents of the cosmetic container and/or relative displacement between main body 103 and outer body 109. Accordingly, a frictional resistance between main body 103 and outer body 109 at the abutment portion 105 can substantially remain unchanged to maintain smooth extraction/retraction characteristics of the cosmetic container.

There is also an improved airtightness at the coupling portion 135 between insert sleeve 107 inner cap 127, more particularly between projection 131 and recess 133.

In the above-mentioned embodiment, various modifications can be made. For example, rib 119 may be formed as a continuous, endless annular projection.

Figure 27:
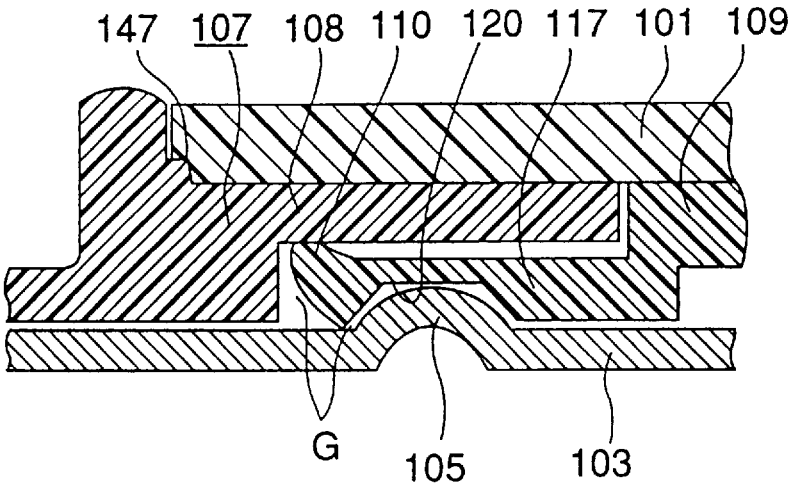
FIG. 27 is an enlarged view showing N portion of a modified embodiment of the cosmetic container.

FIG. 27 shows another embodiment of the active portion. In this embodiment, the upper end portion 110 of active portion 117 is spread outwardly to contact with the inner peripheral surface of insert sleeve 107. The upper end portion 110 acts like rib 119 and functions in the same manner.

Figure 28:
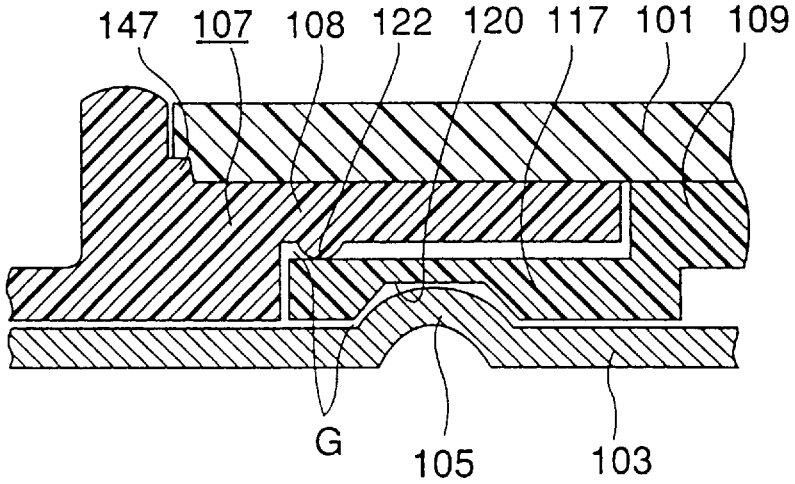
FIG. 28 is an enlarged view showing N portion of a still modified embodiment of the cosmetic container.
Figure 29:
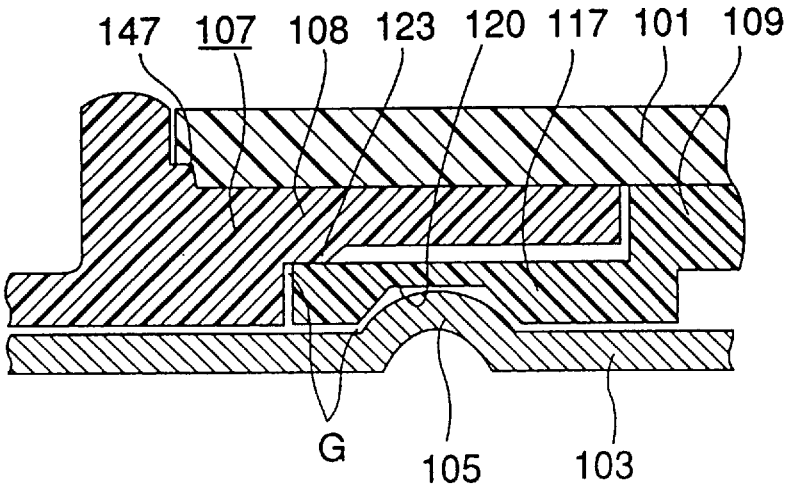
FIG. 29 is an enlarged view showing N portion of a still modified embodiment of the cosmetic container.

Further, rib 119 may be replaced by an annular rib 122 formed on the inner peripheral surface of insert sleeve 107, as shown in FIG. 28. Rib 122 may be an endless one or formed as a series of spaced dot-like projections. A portion of insert sleeve 107 may be thickened to provide an inward projection 123 for abutment with the top end portion of active portion 117, as shown in FIG. 29.

Cosmetic holder 113 may have desired shape and form, as having been described in connection with embodiments shown in FIGS. 8 to 11. For example, it may be an oval in cross-section (FIG. 8). It may be provided with a pair of opposed projections (13*a*, 13*a* in FIG. 9) extending longitudinally along the outer peripheral surface thereof. Longitudinally extending projections may be positioned only at the lower end of holder 13, which are shown as projections 13*b*, 13*b* in FIG. 10. Spaced projections (13*c* in FIG. 11) may be formed on the outer peripheral surface of the bottom of a receptacle portion 114.

Figure 30:
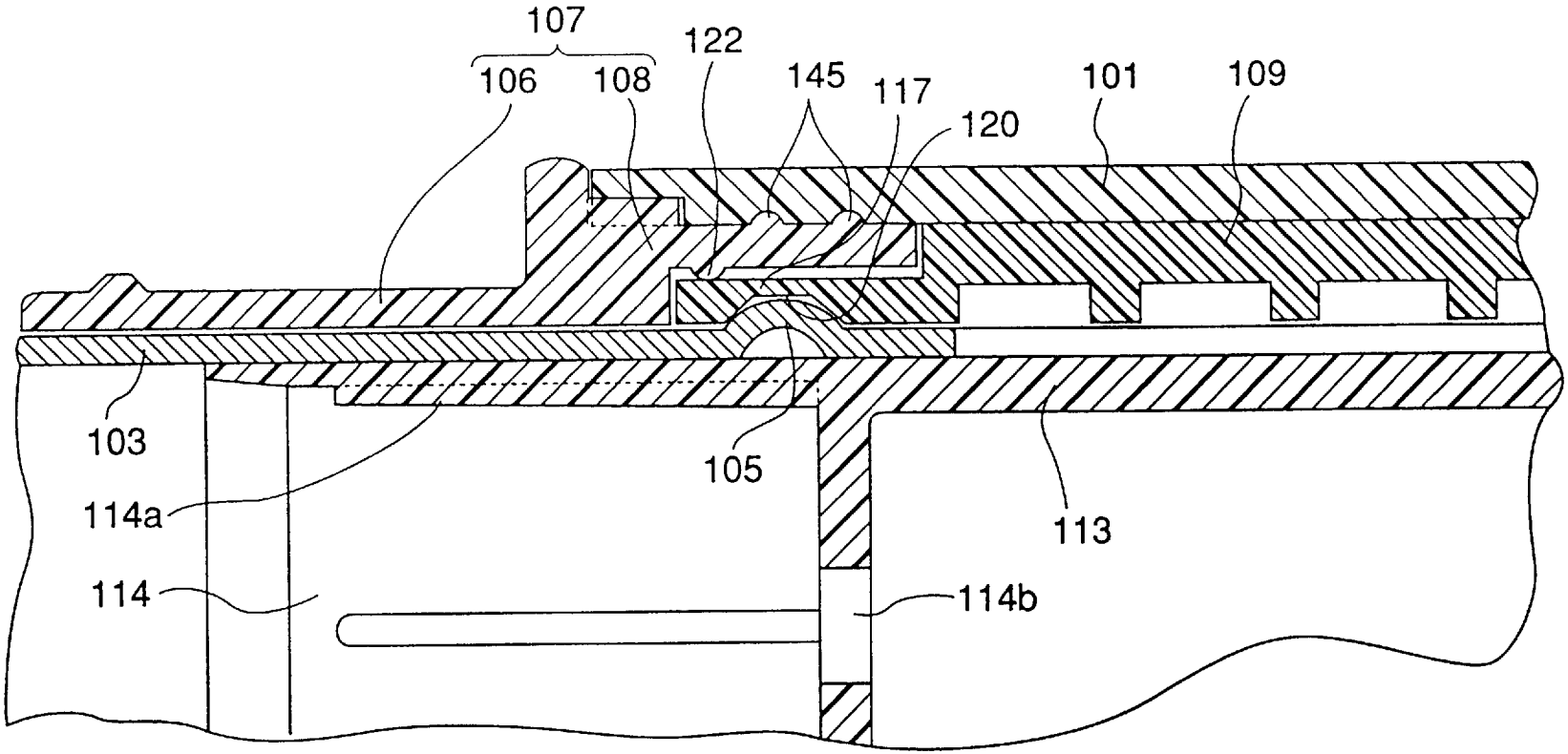
FIG. 30 is an enlarged view showing N portion of a still modified embodiment of the cosmetic container.
Figure 31:
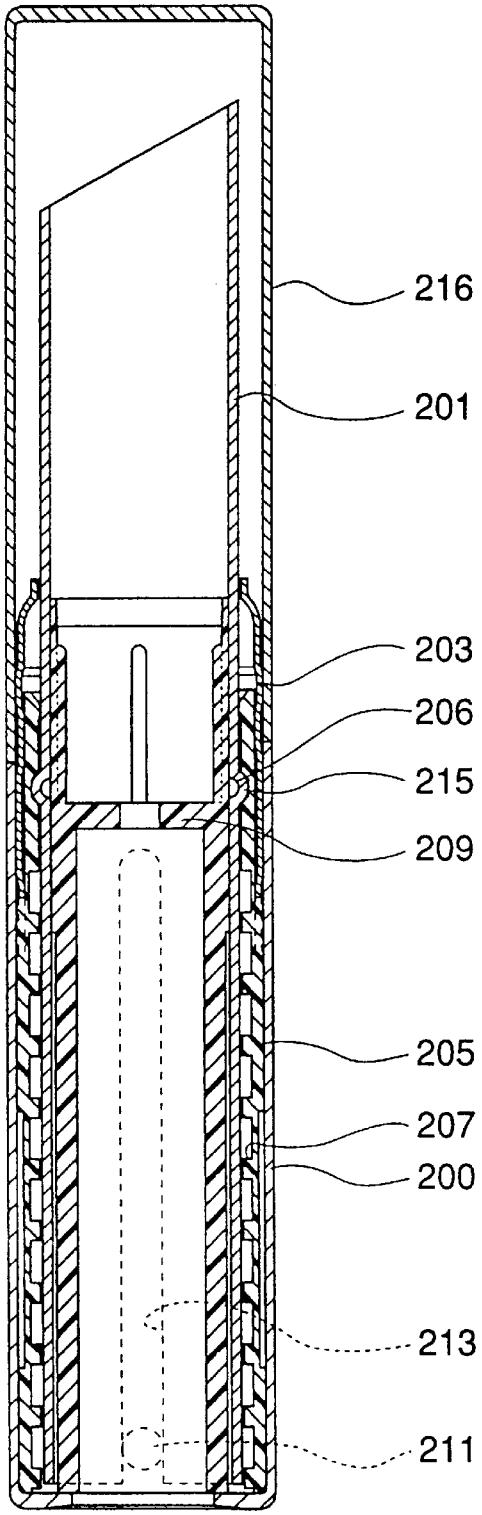
FIG.31 PRIOR ART
FIG. 31 is a longitudinal cross-sectional view showing a prior art cosmetic container.

Insert sleeve 107 is coupled to casing 101 at a suitable location by welding or any suitable connecting means. In an embodiment of FIG. 30, insert sleeve 107 is press-fit to casing 101. More particularly, the inner peripheral surface of the lower portion 108 of insert sleeve 107 is provided with one or more of annular ribs 145, which are engageable with corresponding annular grooves when lower portion 108 is inserted into casing 101. The cosmetic container shown in FIG. 30 is of an insertion type in which a solid cosmetic is inserted into receptacle 114. Receptacle 114 is provided with longitudinal projections 114*a* at its inner wall and an aperture 114*b* at its bottom.

Suitable stop means may be employed for preventing relative rotation between adjacent members. Several examples of such rotation-stopper has been described in connection with FIGS. 12 to 19, any one or combination of which is applicable to the embodiment shown in FIG. 22 or in FIG. 30.

The cosmetic container of the present invention may contain any type of stick-like cosmetic such as a lipstick and foundation in a solid, paste, gel or any other form.

Respective constituents of the cosmetic container of the present invention may be made from suitable materials. For example, the casing, the insert sleeve and the cap are made of metal, and the inner cap fitted within the cap is coupled to the insert sleeve, in which case the cosmetic container has an improved airtightness. When the casing, the insert sleeve and the cap are made of resin, airtightness of the cosmetic container becomes poor, which can be increased by connecting integrally the insert sleeve and the casing by ultrasonic-welding, for example. The inner cap may not be employed. When the casing, the insert sleeve and the cap are made of resin and the cap is directly fitted to the insert sleeve, the container has a poor airtightness. The main body may be made of resin.

Although it is preferable that main body 103 having bead projection 105 is a straight pipe formed by drawing, it may also be a pressing-pipe formed by pressing a flat plate, as in the prior art technique.

The cosmetic container of the present invention may be of a bottom-filling type (FIG. 22) in which a molten cosmetic is filled through the bottom aperture into the cosmetic holder, a direct-filling type in which a molten cosmetic is filled into the holder through the upper open end thereof, or an insertion type (FIG. 30) in which a solid cosmetic is inserted from the above into the holder. In the bottom- and direct-filling type container, after the cosmetic is solidified, a mold is removed from the holder and the container is closed by the cap. In the bottom-filling type container, after completing the cosmetic filling operation, the bottom aperture is closed by a seal. The direct-filling type container has no bottom aperture 114*b*.

Material form which the respective constituents of the cosmetic container is not limitative in the present invention. For example, the casing, the insert sleeve and the cap are made of metal, and an inner cap fitted in the cap is detachably mounted to the insert sleeve, in which case there is provided a cosmetic container having a high airtightness. Engagement between an internal projection of the inner cap and a corresponding recess on the outer periphery of the insert sleeve will further improve airtightness of the container. When the casing, the insert sleeve and the cap are made of resin, airtightness of the container becomes poor, but can be increased by ultrasonic-welding the insert sleeve to the casing. The inner cap may not be employed. The main body may be made of metal or resin. The cosmetic holder is usually made of polypropylene in the direct-filling or insertion type container, and polybutylene terephthalate (PBT) in the bottom-filling type container, but any other material can of course be used.

It is to be understood that while the present invention has been described in connection with a limited number of particular examples, no limitation is intended thereby except as defined in the appended claims.

What is claimed is:

1. A cosmetic container comprising:

a main body provided at a lower portion thereof with slot means extending in a longitudinal direction;

an outer body provided internally with a continuous spiral groove, said outer body surrounding said main body substantially in close relation to each other but allowing relative rotation therebetween;

a casing integrally fitted around said outer body;

a cosmetic holder accommodated within said main body substantially in close relation to each other but allowing relative longitudinal sliding movement therebetween, said cosmetic holder being provided with projection means projecting outwardly therefrom through said slot means to be in engagement with said continuous spiral groove so that said cosmetic holder moves longitudinally with respect to said main body in response to rotation of said outer body and said casing;

an insert sleeve having an upper portion surrounding rotatable said main body and a lower portion interposed between said outer body and said casing;

the upper portion of said outer body providing integrally a relatively thin active portion positioned between said main body and said insert sleeve with gaps therebetween; and said active portion having internally projecting means for engagement with said main body and a free end portion for engagement with said insert sleeve, whereby said active portion can provide elastic deformation with said internally projecting means acting as a fulcrum when an external force is applied to said free end portion.

2. The cosmetic container according to claim 1 wherein said active portion has an inner diameter larger than an inner diameter of a lower main portion of said outer body and an outer diameter smaller than an outer diameter of said lower main portion.

3. The cosmetic container according to claim 1 wherein the inner peripheral surface of said insert sleeve projects inwardly at a position above said internal projecting means of said active portion for contacting with the outer peripheral surface of said active portion.

4. The cosmetic container according to claim 1 wherein the upper end portion of said active portion is spread out toward said insert sleeve for contacting with the inner peripheral surface of said insert sleeve.

5. The cosmetic container according to claim 1 wherein said internal projecting means of said active portion is formed as a series of spaced, annually arranged dot-like projections.

6. The cosmetic container according to claim 1 wherein said internal projecting means of said active portion is formed as an endless continuous annular rib.

7. The cosmetic container according to claim 1 wherein the outer peripheral surface of the upper end portion of said active portion is provided with circumferentially external projecting means.

8. The cosmetic container according to claim 7 wherein said external projecting means is formed as a series of spaced, annually arranged dot-like projections.

9. The cosmetic container according to claim 7 wherein said external projecting means is formed as an endless continuous annular rib.

10. The cosmetic container according to claim 1 wherein said active portion extends from the upper end of said outer body to above an abutment at which said main body is engaged with said outer body to be prevented from removal out of said outer body.

11. The cosmetic container according to claim 10 wherein a lower portion of said insert sleeve is straight-extending.

12. The cosmetic container according to claim 10 wherein a lower portion of said insert sleeve is spread out toward said outer body.

13. The cosmetic container according to claim 1 wherein said active portion extends from the upper end of said outer body to below an abutment at which said main body is engaged with said outer body to be prevented from removal out of said outer body.

14. The cosmetic container according to claim 13 wherein a lower portion of said insert sleeve is straight-extending.

15. The cosmetic container according to claim 13 wherein a lower portion of said insert sleeve is spread out toward said outer body.

16. The cosmetic container according to claim 1 which further comprises a casing surrounding said outer body and cap with an inner cap detachably engaged with said insert sleeve with an airtight condition, wherein said casing, said insert sleeve and said cap are all made of metal.

17. A cosmetic container comprising:

a main body provided at a lower portion thereof with slot means extending in a longitudinal direction;

an outer body provided internally with a continuous spiral groove, said outer body surrounding said main body substantially in close relation to each other but allowing relative rotation therebetween;

a casing integrally fitted around said outer body;

a cosmetic holder accommodated within said main body substantially in close relation to each other but allowing relative longitudinal sliding movement therebetween, said cosmetic holder being provided with projection means projecting outwardly therefrom through said slot means to be in engagement with said continuous spiral groove so that said cosmetic holder moves longitudinally with respect to said main body in response to rotation of said outer body and said casing;

an insert sleeve having an upper portion surrounding rotatable said main body and a lower portion fitted internally of said casing;

the upper portion of said outer body providing integrally an active portion positioned between said main body and the lower portion of said insert sleeve with gaps therebetween; and said active portion being elastically engaged with the inner peripheral surface of said insert sleeve to thereby allow elastic deformation of said active portion.

18. The cosmetic container according to claim 17 wherein said active portion is provided with circumferentially external projecting means for contacting with the inner peripheral surface of said insert sleeve.

19. The cosmetic container according to claim 18 wherein said external projecting means is formed as a series of spaced, annually arranged dot-like projections.

20. The cosmetic container according to claim 18 wherein said external projecting means is formed as an endless continuous annular rib.

21. The cosmetic container according to claim 17 wherein the upper end of said active portion is spread out toward said insert sleeve for contacting the inner peripheral surface of said insert sleeve.

22. The cosmetic container according to claim 17 wherein the inner peripheral surface of said insert sleeve is provided with circumferentially internal projecting means for contacting with the outer peripheral surface of said active portion.

23. The cosmetic container according to claim 22 wherein said internal projecting means is formed as a series of spaced, annually arranged dot-like projections.

24. The cosmetic container according to claim 22 wherein said internal projecting means is formed as an endless continuous annular rib.

* * * * *